US011718095B2

(12) United States Patent
Yamagishi et al.

(10) Patent No.: US 11,718,095 B2
(45) Date of Patent: Aug. 8, 2023

(54) FLOW CHANNEL MEMBER, LIQUID EJECTING HEAD, LIQUID EJECTING APPARATUS, AND METHOD FOR MANUFACTURING LIQUID EJECTING APPARATUS

(71) Applicant: Seiko Epson Corporation, Tokyo (JP)

(72) Inventors: Ken Yamagishi, Shiojiri (JP); Shigeki Suzuki, Matsumoto (JP); Kenichi Kitamura, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 14 days.

(21) Appl. No.: 17/558,740

(22) Filed: Dec. 22, 2021

(65) Prior Publication Data

US 2022/0203684 A1 Jun. 30, 2022

(30) Foreign Application Priority Data

Dec. 24, 2020 (JP) ..... 2020-215871

(51) Int. Cl.

| | |
|---|---|
| ***B41J 2/14*** | (2006.01) |
| ***B41J 2/16*** | (2006.01) |
| ***B41J 11/00*** | (2006.01) |

(52) U.S. Cl.

CPC ..... *B41J 2/14233* (2013.01); *B41J 2/161* (2013.01); *B41J 2/1623* (2013.01); *B41J 11/00214* (2021.01); *B41J 2202/08* (2013.01)

(58) Field of Classification Search

CPC ..... B41J 2/14233; B41J 2/161; B41J 2/1623; B41J 11/00214; B41J 2202/08; B41J 29/38; B41J 2/175

See application file for complete search history.

(56) References Cited

U.S. PATENT DOCUMENTS

| | | | | |
|---|---|---|---|---|
| 2007/0070122 | A1* | 3/2007 | Bertelsen | B41J 2/1433 347/44 |
| 2018/0079213 | A1 | 3/2018 | Hanagami et al. | |
| 2019/0184702 | A1 | 6/2019 | Takekoshi et al. | |

FOREIGN PATENT DOCUMENTS

| | | |
|---|---|---|
| JP | 2017-056688 | 3/2017 |
| JP | 2018-047599 | 3/2018 |
| JP | 2019-107775 | 7/2019 |
| JP | 2020-066203 | 4/2020 |

* cited by examiner

*Primary Examiner* — Bradley W Thies

(74) *Attorney, Agent, or Firm* — Workman Nydegger

(57) ABSTRACT

A flow channel member includes a first flow channel member non-transmissive of ultraviolet light and absorbent of laser light, a second flow channel member non-transmissive of ultraviolet light and absorbent of laser light, the second flow channel member being stacked on the first flow channel member to define a flow channel for liquid to flow between the second flow channel member and the first flow channel member, and a third flow channel member transmissive of laser light, the third flow channel member being fixed to the first flow channel member and the second flow channel member in such a manner as to close a gap between the first flow channel member and the second flow channel member.

17 Claims, 14 Drawing Sheets

FLOW CHANNEL MEMBER, LIQUID EJECTING HEAD, LIQUID EJECTING APPARATUS, AND METHOD FOR MANUFACTURING LIQUID EJECTING APPARATUS

The present application is based on, and claims priority from JP Application Serial Number 2020-215871, filed Dec. 24, 2020, the disclosure of which is hereby incorporated by reference herein in its entirety.

BACKGROUND

1. Technical Field

The present disclosure relates to a flow channel member inside which a flow channel is provided, a liquid ejecting head having the flow channel member, a liquid ejecting apparatus including the liquid ejecting head, a liquid ejecting apparatus having the flow channel member, and a method for manufacturing the liquid ejecting apparatus.

2. Related Art

A liquid ejecting apparatus includes a liquid ejecting head that ejects droplets of a liquid, such as an ink, supplied from a liquid retainer, such as an ink tank, from multiple nozzles by utilizing a change in pressure caused by pressure generating means. The liquid ejecting apparatus also uses a flow channel member provided with flow channels for supplying and discharging the ink from the liquid retainer (see, for example, JP-A-2018-47599).

A flow channel member of JP-A-2018-47599 or the like is transmissive of light because it is formed by laser bonding. For this reason, when an ultraviolet light curable ink is used, the ink inside the flow channels cures due to external ultraviolet light. Thus, an ultraviolet light curable ink cannot be used when the flow channel member is transmissive of light.

This problem resides not only in flow channel members in a liquid ejecting head typified by an ink jet recording head and a liquid ejecting apparatus typified by an ink jet recording apparatus, but also in other types of flow channel members.

SUMMARY

An aspect of the present disclosure for solving the above problem is a flow channel member including: a first flow channel member non-transmissive of ultraviolet light and absorbent of laser light; a second flow channel member non-transmissive of ultraviolet light and absorbent of laser light, the second flow channel member being stacked on the first flow channel member to define a flow channel for liquid to flow between the second flow channel member and the first flow channel member; and a third flow channel member transmissive of laser light, the third flow channel member being fixed to the first flow channel member and the second flow channel member in such a manner as to close a gap between the first flow channel member and the second flow channel member.

Another aspect of the present disclosure is a liquid ejecting head including the flow channel member according to the above aspect and a nozzle that ejects liquid supplied from the flow channel member.

Another aspect of the present disclosure is a liquid ejecting apparatus including the liquid ejecting head according to the above aspect and a liquid retainer that retains liquid to be supplied to the flow channel member.

Another aspect of the present disclosure is a liquid ejecting apparatus including: the flow channel member according to the above aspect; a nozzle that ejects liquid supplied from the flow channel member; and a liquid retainer that retains liquid to be supplied to the flow channel member.

Another aspect of the present disclosure is a method for manufacturing a liquid ejecting apparatus including a nozzle that ejects liquid and a flow channel member having a first flow channel member non-transmissive of ultraviolet light and absorbent of laser light, a second flow channel member non-transmissive of ultraviolet light and absorbent of laser light, the second flow channel member being stacked on the first flow channel member to define a flow channel for liquid to flow between the second flow channel member and the first flow channel member, and a third flow channel member transmissive of laser light, the method including fixing the third flow channel member to the first flow channel member and to the second flow channel member by laser bonding in such a manner that the third flow channel member closes a gap between the first flow channel member and the second flow channel member.

DESCRIPTION OF EXEMPLARY EMBODIMENTS

Figure 1:
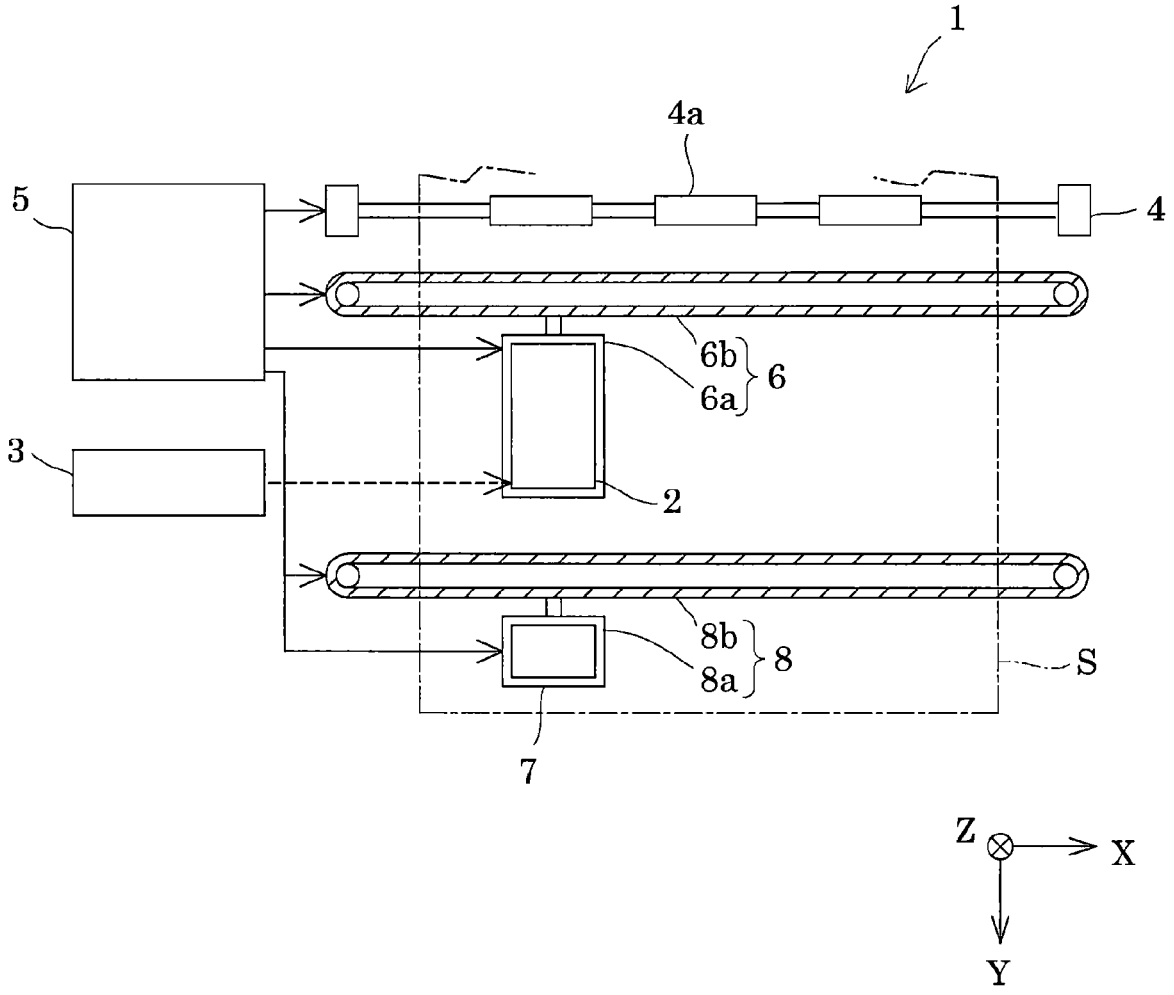
FIG. 1 is a schematic diagram of an ink jet recording apparatus according to Embodiment 1.

The following describes the present disclosure in detail based on embodiments. It should be noted, however, that the following description merely shows an aspect of the present disclosure and that the present disclosure can be modified in any way without departing from the scope of the present disclosure. Throughout the drawings, the same members are denoted by the same reference numerals to omit description where appropriate. Also, in the drawings, X, Y, and Z represent three spatial axes orthogonal to one another. Herein, directions along these axes are referred to as an X-direction, a Y-direction, and a Z-direction. In the drawings, the direction pointed by an arrow is a positive (+) direction, and a direction opposite from the direction pointed by the arrow is a negative (−) direction. The three X, Y, and Z spatial axes are referred to simply as X, Y, and Z axes, respectively, when there is no limitation as to whether the direction is positive or negative.

Embodiment 1

FIG. 1 is a diagram showing a schematic configuration of an ink jet recording apparatus 1 which is a liquid ejecting apparatus according to Embodiment 1 of the present disclosure.

As shown in FIG. 1, the ink jet recording apparatus 1 of the present embodiment which is an example of the "liquid ejecting apparatus" is a printing apparatus that prints an image or the like on a medium S such as a print sheet by ejecting ink, which is a type of liquid, as droplets to the medium S so that the droplets land on the medium S and form lines of dots on the medium S. Besides a recording sheet, the medium S may be any material such as a resin film or a cloth.

In the following description, the three spatial axes, namely the X-axis, the Y-axis, and the Z-axis, are set such that the direction in which an ink jet recording head 10 to be described later moves (in other words, a main scanning direction) is a direction along the X-axis, the transport direction of the medium S, which is orthogonal to the main scanning direction, is a +Y-direction along the Y-axis, a nozzle surface 12 where nozzles 11 of the ink jet recording head 10 are formed is parallel to an XY plane, and ink droplets are ejected in a +Z-direction along the Z-axis.

The ink jet recording apparatus 1 includes: a head unit 2 that includes the ink jet recording head 10 (hereinafter also referred to simply as a recording head 10) which is an example of the "liquid ejecting head"; liquid reservoirs 3; a transport mechanism 4 that feeds the medium S; a control unit 5 which is a controller; a mover mechanism 6; an irradiator 7; and an irradiator mover mechanism 8.

The liquid reservoirs 3 are an example of the "liquid retainer" and each individually retain one of multiple types (e.g., multiple colors) of ink to be ejected from the head unit 2. Note that examples of the "liquid retainer" include a cartridge detachably attachable to the ink jet recording apparatus 1, a bag-shaped ink pack formed of a flexible film, and an ink tank which can be replenished with ink. Although not shown, there are multiple liquid reservoirs 3 corresponding to multiple types of ink different in color or kind. Although the multiple liquid reservoirs 3 are provided in the present embodiment, the multiple liquid reservoirs 3 are shown in FIG. 1 as one collectively.

The control unit 5 is configured including, for example, a control device such as a central processing unit (CPU) or a field-programmable gate array (FPGA) and a storage device such as a semiconductor memory device, although they are not shown. By executing the programs stored in the storage device, the control unit 5 performs overall control of the elements of the ink jet recording apparatus 1, such as the transport mechanism 4, the mover mechanism 6, and the head unit 2.

The transport mechanism 4 is an example of a "transport section" that transports the medium S in the −Y-direction or the +Y-direction as controlled by the control unit 5, and has, for example, transport rollers 4*a*. The transport mechanism 4 that transports the medium S is not limited to the transport rollers 4*a* and may transport the medium S using a belt or drum.

As controlled by the control unit 5, the mover mechanism 6 moves the head unit 2 along the X-axis in the +X-direction and in the −X-direction in a reciprocating manner. The +X-direction and the −X-direction in which the head unit 2 is caused to reciprocate by the mover mechanism 6 intersect with the −Y-direction and the +Y-direction in which the medium S is transported.

The mover mechanism 6 of the present embodiment includes a transporter 6*a* and a transport belt 6*b*. The transporter 6*a* is a substantially box-shaped structure, i.e., a carriage, that houses the head unit 2, and is fixed to the transport belt 6*b*. The transport belt 6*b* is an endless belt looped along the X-axis. When the transport belt 6*b* rotates as controlled by the control unit 5, the head unit 2 moves in a reciprocating manner along the X-axis in the +X-direction and the −X-direction along with the transporter 6*a*. It is also possible to mount the liquid reservoirs 3 to the transporter 6*a* together with the head unit 2.

The irradiator 7 is provided downstream of the recording head 10 in the +Y-direction, which is the transport direction of the medium S, and is formed of an ultraviolet light irradiation lamp (also called a UV lamp) that applies ultraviolet (UV) light to the medium S, i.e., in the +Z-direction. The irradiator 7 irradiates the medium S with ultraviolet light as controlled by the control unit 5.

As controlled by the control unit 5, the irradiator mover mechanism 8 moves the irradiator 7 along the X-axis in the +X-direction and the −X-direction in a reciprocating manner. The +X-direction and the −X-direction in which the irradiator 7 is caused to reciprocate by the irradiator mover mechanism 8 intersect with the −Y-direction or the +Y-direction in which the medium S is transported.

The irradiator mover mechanism 8 of the present embodiment includes an irradiator transporter 8*a* and an irradiator transport belt 8*b*. The irradiator transporter 8*a* is a substantially box-shaped structure, i.e., a carriage, that houses the irradiator 7, and is fixed to the irradiator transport belt 8*b*. The irradiator transport belt 8*b* is an endless belt looped along the X-axis. When the irradiator transport belt 8*b* rotates as controlled by the control unit 5, the irradiator 7 moves in a reciprocating manner along the X-axis in the +X-direction and the −X-direction along with the irradiator transporter 8*a*. It is also possible to mount the irradiator 7 in the transporter 6*a* together with the head unit 2. Also, the irradiator 7 may be one that applies ultraviolet light to the print region on the medium S for the entire width along the X-axis at once, and in that case, the irradiator mover mechanism 8 is unneeded.

As controlled by the control unit 5, the recording head 10 ejects ink supplied from the liquid reservoirs 3 toward the medium S as ink droplets which are liquid droplets. The recording head 10 ejects ink droplets in the +Z-direction as described above. Then, while the medium S is transported by the transport mechanism 4 in the −Y-direction or the +Y-direction, the recording head 10 ejects ink droplets to the medium S while being transported by the mover mechanism 6 along the X-axis. As a result, a desired image is formed on the XY plane of the medium S. If an ultraviolet light curable ink is used as the ink ejected from the nozzles of the recording head 10, the ink landed on the medium S is cured and fixated on the medium S by the ultraviolet light applied by the irradiator 7.

Figure 2:
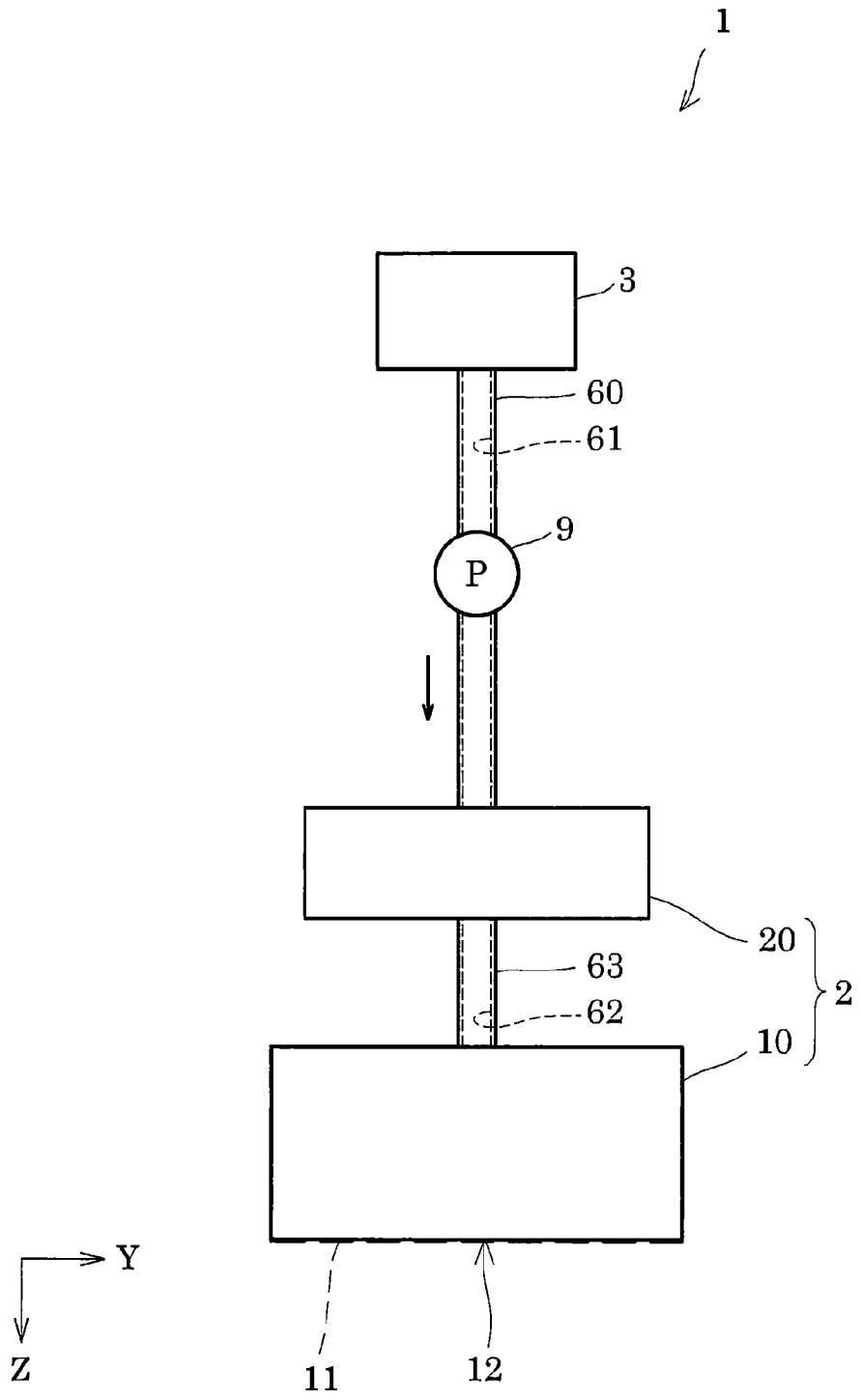
FIG. 2 is a schematic diagram of a liquid reservoir and a head unit according to Embodiment 1.

The head unit 2 of the present embodiment is now described. FIG. 2 is a schematic diagram of the liquid reservoir 3 and the head unit 2.

As shown in FIG. 2, the head unit 2 includes the recording head 10 and flow channel members 20. Although there are actually multiple flow channel members 20 to correspond to the number of the liquid reservoirs 3, i.e., the multiple types of ink different in color or kind, the multiple flow channel members 20 are shown in FIG. 2 as one collectively. It goes without saying that with the same type of ink being divided into two or more branches, two or more flow channel members 20 may be provided for the same type of ink. Also, the head unit 2 may include one recording head 10 or two or more recording heads 10.

The head unit 2 is supplied with ink from the liquid reservoir 3 via a first supply channel 60. The first supply channel 60 is a flow channel through which an ink from the liquid reservoir 3 flows to the flow channel member 20 of the head unit 2, and is provided inside a first supply duct 61 such as, for example, a tube. There are as many first supply channels 60 as the flow channel members 20, but the first supply channels 60 are shown in FIG. 2 as one collectively.

The ink from each liquid reservoir 3 is pneumatically fed to the head unit 2 by a pump 9. The pump 9 is an example of a pneumatic feeding mechanism that pneumatically feeds ink from each liquid reservoir 3 to the head unit 2. Examples of the pump 9 include a tube pump and a diaphragm pump. In the present embodiment, the pump 9 is provided at a midway point on the first supply channel 60. It goes without saying that the pump 9 may be provided at the liquid reservoir 3.

Also, the pneumatic feeding mechanism is not limited to the pump 9, and may be, for example, a pressing means that pressurizes ink retained in the liquid reservoir 3 by pressing the liquid reservoir 3 from outside. The pneumatic feeding mechanism may also be a device that adjusts the vertical positions of the head unit 2 and the liquid reservoir 3 relative to each other and utilizes the difference in their hydraulic head pressure.

At the surface facing the medium S, i.e., the +Z-direction-side surface, the recording head 10 has the nozzle surface 12 at which the nozzles 11 that eject ink, which is liquid, as droplets are open. In its inside (not shown), the recording head 10 is provided with flow channels communicating with the nozzles 11, pressure generation means that generate a change in pressure to the ink in the flow channels, and the like. The pressure generation means may be, for example, a piezoelectric actuator having a piezoelectric material capable of electromechanical transduction. Specifically, the piezoelectric actuator is deformed to change the volumetric capacity of the flow channel, thereby generating a change in pressure to the ink in the flow channel and causing ink droplets to be ejected from the nozzle 11. Another example of the pressure generation means may be one in which a heat generation element is disposed in the flow channel to generate heat which forms bubbles to cause ink droplets to be ejected from the nozzle 11. Yet another example of the pressure generation means is what is called an electrostatic actuator in which an electrostatic force is generated between a vibration plate and an electrode to deform the vibration plate and thereby cause ink droplets to be ejected from the nozzle 11.

Figure 3:
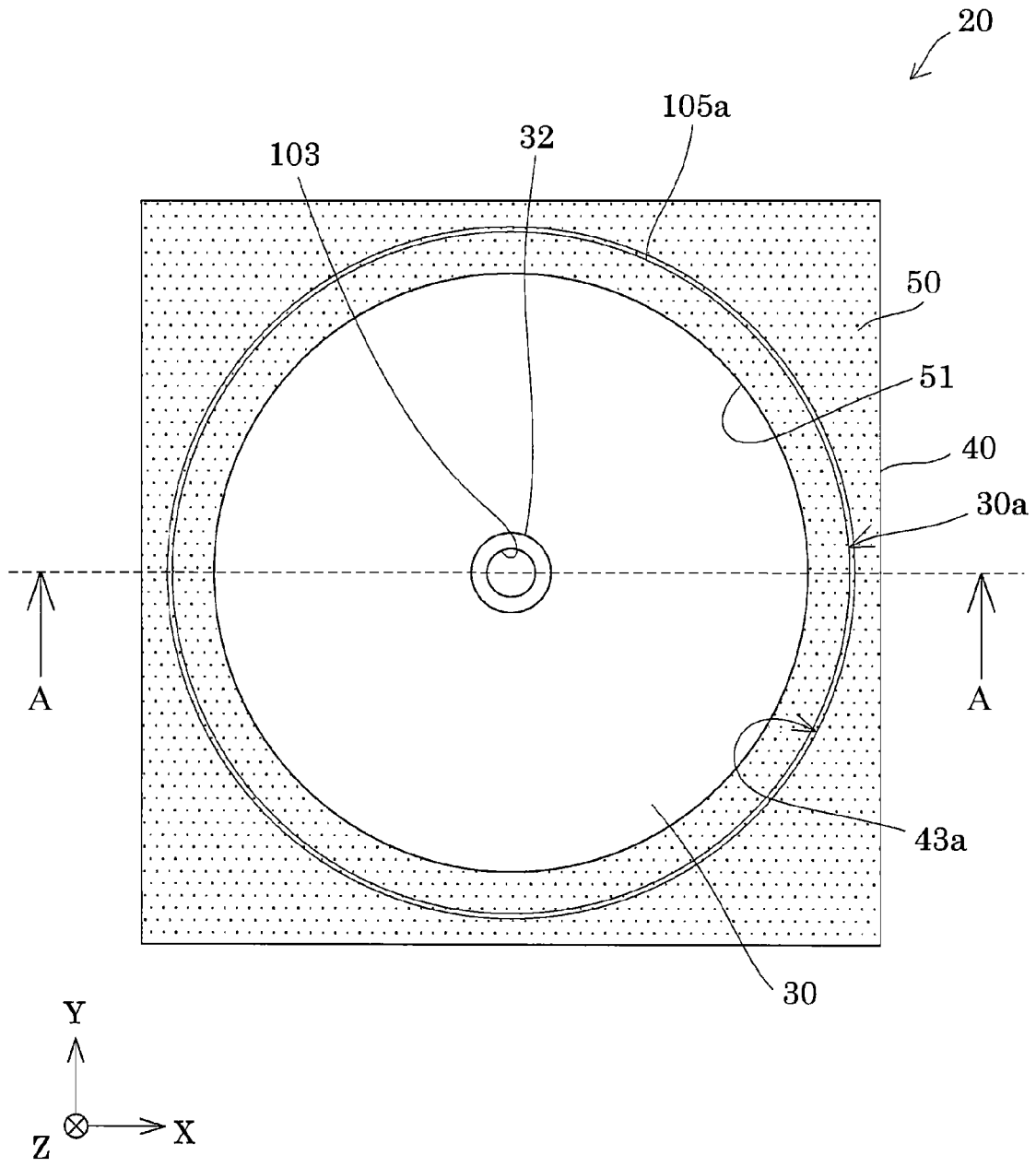
FIG. 3 is a plan view of a flow channel member according to Embodiment 1.
Figure 4:
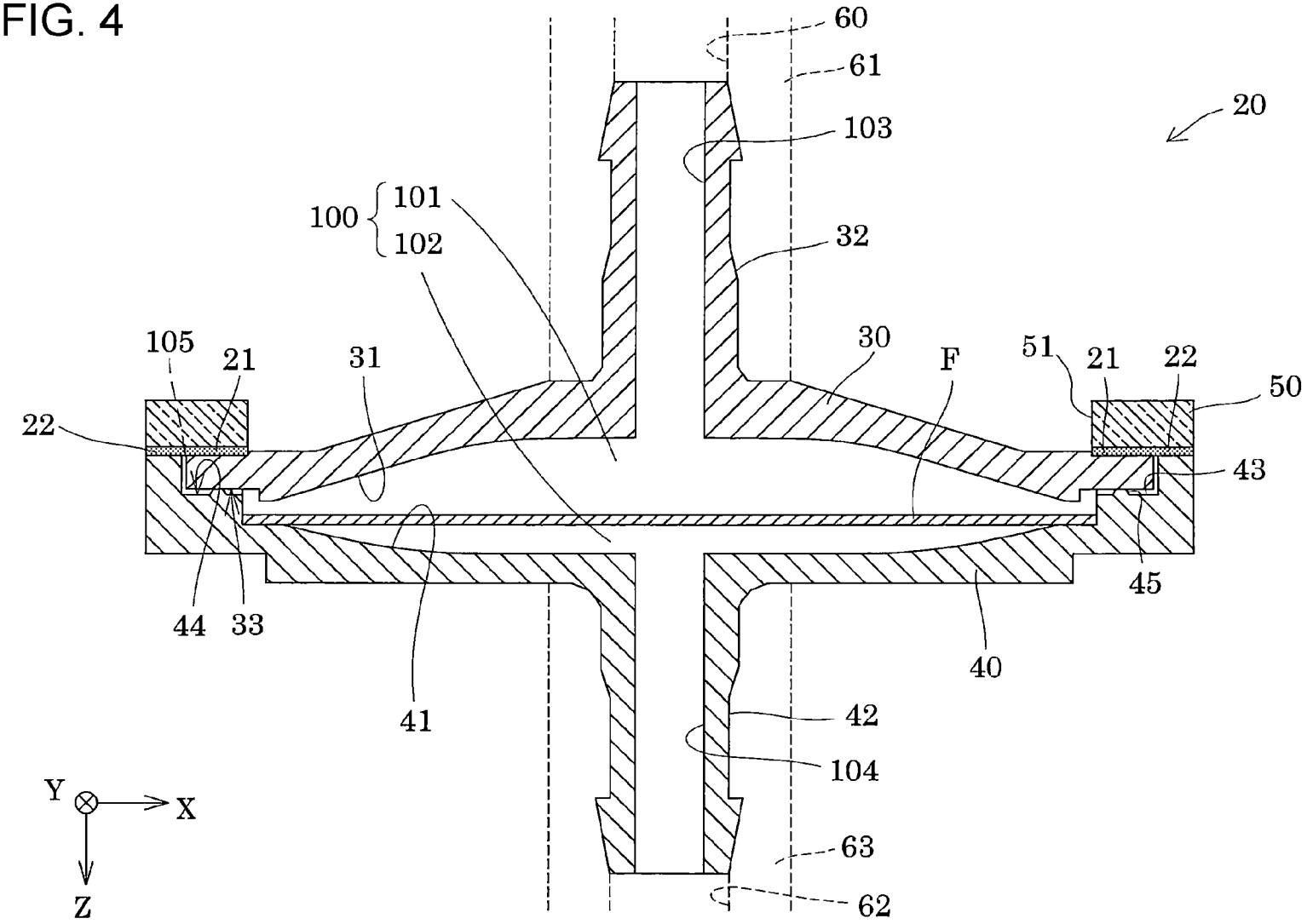
FIG. 4 is a sectional view of the flow channel member according to Embodiment 1.
Figure 5:
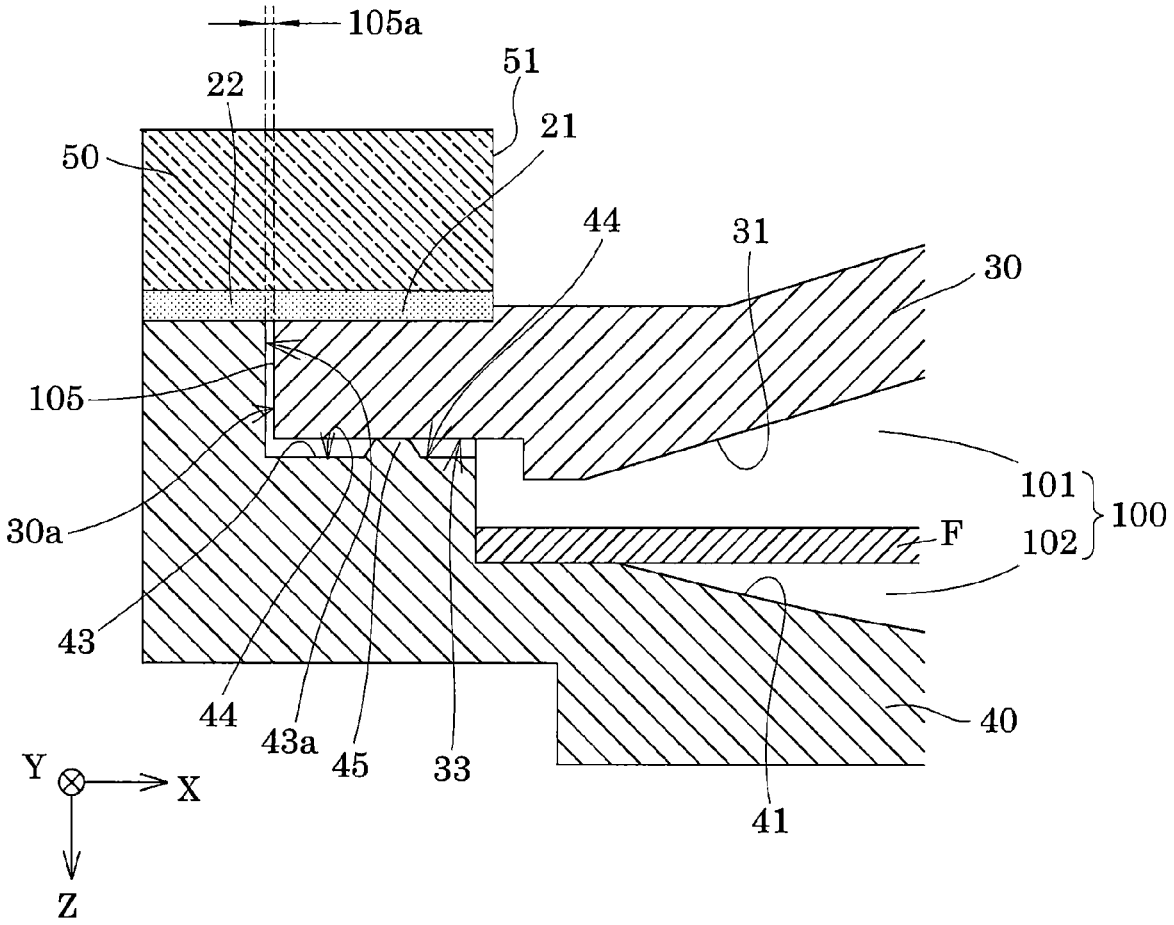
FIG. 5 is a sectional view enlarging a main portion of the flow channel member according to Embodiment 1.

The flow channel members 20 are each internally provided with a flow channel through which ink ("liquid") is supplied from the corresponding liquid reservoir 3. The ink in the flow channel in the flow channel member 20 is supplied to the recording head 10. With reference to FIGS. 3 to 5, a more detailed description is given of the flow channel member 20 of the present embodiment. FIG. 3 is a plan view of the flow channel member 20 seen in the +Z-direction. FIG. 4 is a sectional view taken along the line A-A in FIG. 3. FIG. 5 is a diagram enlarging a main portion of FIG. 3.

As shown, the flow channel member 20 includes a first flow channel member 30, a second flow channel member 40, and a third flow channel member 50.

The first flow channel member 30 and the second flow channel member 40 are stacked on each other along the Z-axis, the first flow channel member 30 being disposed on the −Z-direction side and the second flow channel member 40 being disposed on the +Z-direction side. In other words, the second flow channel member 40 is stacked on the +Z-direction side of the first flow channel member 30.

A flow channel is defined between the first flow channel member 30 and the second flow channel member 40. Specifically, when the second flow channel member 40 is stacked on the +Z-direction side of the first flow channel member 30, a flow channel for ink ("liquid") to flow is defined between the second flow channel member 40 and the first flow channel member 30. In the present embodiment, a filter chamber 100 which is a portion of the flow channel is formed between the first flow channel member 30 and the second flow channel member 40.

The filter chamber 100 is formed by aligning openings of a first recess portion 31 and a second recess portion 41 with each other. The first recess portion 31 is provided at the first flow channel member 30 and opens to the +Z-direction side, and the second recess portion 41 is provided at the second flow channel member 40 and opens to the −Z-direction side. The first recess portion 31 and the second recess portion 41 define the filter chamber 100. The first recess portion 31 of the present embodiment is deeper in the −Z-direction at its center portion as seen in the +Z-direction than at its outer circumferential portion. The second recess portion 41 is deeper in the +Z-direction at its center portion as seen in the +Z-direction than at its outer circumferential portion.

A filter F is fixed at the opening portion of the second recess portion 41 of the second flow channel member 40. The filter F is fixed at the outer circumferential portion of the bottom surface of the second recess portion 41, i.e., a surface which is less deep in the +Z-direction than the center portion. A space is thereby formed between the filter F and the bottom surface of the second recess portion 41, i.e., the +Z-direction-side surface. The filter F is disposed such that the in-plane direction of the principle surface of the filter F, which is a plane along which the filter F extends, may be orthogonal to the +Z-direction, i.e., the stacking direction of the first flow channel member 30 and the second flow channel member 40, or in other words, may be along the XY plane. The filter F is to capture foreign matters in ink, such as air bubbles and dust, and may be in the shape of a sheet having formed therein multiple minute holes by, for example, finely weaving fibers made of metal, resin, or the like. The filter F may also be a plate member made of metal, resin, or the like provided with multiple minute through-holes. The filter F may also be a nonwoven cloth or the like, and the material thereof is not limited to any particular material. Also, the method for fixing the filter F to the second flow channel member 40 is not limited to any particular method, and examples include bonding using an adhesive and thermal bonding.

The filter chamber 100 is sectioned by the filter F into an upstream chamber 101 upstream of the filter F and a downstream chamber 102 downstream of the filter F.

The flow channel member 20 is also provided with an inflow channel 103 and an outflow channel 104 that communicate with the filter chamber 100.

The inflow channel 103 communicates with the upstream chamber 101 of the filter chamber 100 and supplies ink from the external liquid reservoir 3 to the filter chamber 100. The inflow channel 103 penetrates through the first flow channel member 30 along the Z-axis, with one end thereof opening at the tip end of a first coupling portion 32 protruding from the −Z-direction-side surface of the first flow channel member 30. The other end of the inflow channel 103 opens at the bottom surface of the first recess portion 31 of the first flow channel member 30, i.e., the +Z-direction-side surface of the first recess portion 31. The opening at the other end of the inflow channel 103 coupled to the upstream chamber 101 is located at substantially the center portion of the upstream chamber 101 in a plan view seen in the +Z-direction. Note that the first coupling portion 32 is formed of a flow channel duct inside which the inflow channel 103 is provided, and the first supply duct 61, such as a tube, having the first supply channel 60 thereinside is coupled to the first coupling portion 32. It goes without saying that the first coupling portion 32 is not limited to a flow channel duct, and may be a flow channel needle having a pointy end at the −Z-direction side to be inserted into an ink cartridge or the like. Also, the inflow channel 103 is not limited to the one described above, and may be one that extends in a direction intersecting with the Z-axis. Also, the opening of the inflow channel 103 into the upstream chamber 101 may be provided at a side surface of the first recess portion 31, i.e., a surface extending along the Z-axis.

The outflow channel 104 communicates with the downstream chamber 102 of the filter chamber 100 and supplies ink in the filter chamber 100 to the external recording head 10. The outflow channel 104 penetrates through the second flow channel member 40 along the Z-axis, with one end thereof opening at the tip end of a second coupling portion 42 protruding from the +Z-direction-side surface of the second flow channel member 40. The other end of the outflow channel 104 opens at the bottom surface of the second recess portion 41 of the second flow channel member 40, i.e., the −Z-direction-side surface of the second recess portion 41. The opening at the other end of the outflow channel 104 coupled to the downstream chamber 102 is located at substantially a center portion of the downstream chamber 102 in a plan view seen in the +Z-direction. Note that the second coupling portion 42 is formed of a flow channel duct inside which the outflow channel 104 is provided, and is coupled to a second supply duct 63, such as a tube, having a second supply channel 62 thereinside and coupled to the recording head 10. It goes without saying that the second coupling portion 42 is not limited to a flow channel duct, and may be a flow channel needle having a pointy end at the +Z-direction side to be inserted directly into the recording head 10. Also, the outflow channel 104 is not limited to the one described above, and may be one that extends in a direction intersecting with the Z-axis. Also, the opening of the outflow channel 104 into the downstream chamber 102 may be provided at a side surface of the second recess portion 41, i.e., a surface extending along the Z-axis.

The second flow channel member 40 is provided with a third recess portion 43 having an opening which is located on the −Z-direction side and which is larger than that of the second recess portion 41. The first flow channel member 30 is inserted into this third recess portion 43. In other words, the first flow channel member 30 has an outer shape insertable into the third recess portion 43 and larger than the second recess portion 41. In other words, the third recess portion 43 is slightly larger in dimension than the outer shape of the first flow channel member 30. Thus, the first flow channel member 30 is inserted into the third recess portion 43 in the +Z-direction such that a first surface 33 on the +Z-direction side abuts against a second surface 44 of the second recess portion 41, thereby restricted from moving in the +Z-direction. The second surface 44 is a bottom surface of the third recess portion 43 which is outward of the second recess portion 41 and is on the +Z-direction side. Although details will be given later, in the present embodiment, the second surface 44 of the second flow channel member 40 is provided with a bump portion 45 protruding in the −Z-direction, and the first surface 33 of the first flow channel member 30 abuts against the bump portion 45, thereby restricted from moving in the +Z-direction. Also, when the first flow channel member 30 is inserted into the third recess portion 43, a gap 105 is formed between an outer circumferential surface 30*a* of the first flow channel member 30 extending along the Z-axis and an internal side surface 43*a* of the third recess portion 43 extending along the Z-axis orthogonal to the second surface 44. Manufacturing the first flow channel member 30 and the second flow channel member 40 in dimensions that allow the gap 105 to be formed between the outer circumferential surface of the first flow channel member 30 and the internal side surface of the third recess portion 43 of the second flow channel member 40 helps prevent interference from occurring at the time of the insertion of the first flow channel member 30 into the third recess portion 43 and therefore enables easy assemblage.

The third flow channel member 50 is fixed to the first flow channel member 30 and the second flow channel member 40 in such a manner as to close the gap 105 between the first flow channel member 30 and the second flow channel member 40. In the present embodiment, the third flow channel member 50 is fixed to the first flow channel member 30 and the second flow channel member 40 in such a manner as to lid an opening 105*a*, on the −Z-direction side, of the gap 105 between the first flow channel member 30 and the second flow channel member 40. What is meant by the third flow channel member 50 closing the gap 105 between the first flow channel member 30 and the second flow channel member 40 is that the third flow channel member 50 closes the gap 105 so that ink inside the flow channel member 20 may not flow out to the outside through the gap 105 or so that ink and the like may not flow into the gap 105 from the outside. The third flow channel member 50 of the present embodiment closes the gap 105 between the first flow channel member 30 and the second flow channel member 40 by being fixed to the −Z-direction side of the first flow channel member 30 inside the opening 105*a* of the gap 105 and the −Z-direction side of the second flow channel member 40 outside the opening 105*a* of the gap 105 in such a manner as to extend over the opening 105*a* of the gap 105.

The third flow channel member 50 does not form a flow channel between itself and the first flow channel member 30 or the second flow channel member 40, and therefore only needs to be large enough to extend at least onto both sides of the opening 105*a* of the gap 105 in a straddling manner as seen in the +Z-direction, i.e., onto the inner first flow channel member 30 and onto the outer second flow channel member 40. In the present embodiment, the opening 105*a* of the gap 105 between the first flow channel member 30 and the second flow channel member 40 is provided in a continuous annular form when seen in the +Z-direction, and the third flow channel member 50 is provided in a continuous annular form throughout the opening 105*a* of the gap 105 provided in the annular form. More specifically, the third flow channel member 50 of the present embodiment has a through-hole 51 through which the first coupling portion 32 is inserted into the center portion of the first flow channel member 30 in terms of the XY plane. Then, when seen in the +Z-direction which is the "stacking direction," the third flow channel member 50 has an outer circumference which is substantially the same in size as the outer circumference of the second flow channel member 40 and an inner circumference, i.e., the through-hole 51, which is smaller in size than the first flow channel member 30. In other words, the third flow channel member 50 has a smaller area than the first flow channel member 30 or the second flow channel member 40 when seen in the +Z-direction, which is the staking direction of the first flow channel member 30 and the second flow channel member 40. When the third flow channel member 50 thus has a smaller area than the first flow channel member 30 or the second flow channel member 40 when seen in the +Z-direction, the third flow channel member 50 can be reduced in size and thus in costs. In other words, the compactness of the third flow channel member 50 can be achieved because there is no flow channel formed between the third flow channel member 50 and the first flow channel member 30 or the second flow channel member 40. It should be noted that "annular" means not only a circular shape, but also any endless shape such as an oval shape, a rectangular shape, or a polygonal shape.

Although the third flow channel member 50 of the present embodiment is provided in a continuous annular form throughout the opening 105*a* of the annular gap 105 between the first flow channel member 30 and the second flow channel member 40, the present disclosure is not limited to this. For example, the third flow channel member 50 may be provided discontinuously with respect to the opening 105*a* of the annular gap 105 in a plan view seen in the +Z-direction as long as the third flow channel member 50 is sealed at the flow-channel side of the gap 105, i.e., at the filter chamber 100 side. However, by providing the third flow channel member 50 continuously throughout the opening 105*a* of the gap 105, even if ink in the filter chamber 100 leaks into the gap 105 through a seal portion, the ink in the gap 105 can be prevented from leaking out by a first layer 21 and a second layer 22, which will be detailed later, where the third flow channel member 50 is melted with the first flow channel member 30 and with the second flow channel member 40, respectively.

The first layer 21 is formed on the −Z-direction side of the first flow channel member 30 located inside the opening 105*a* of the gap 105 when the flow channel member 20 is seen in the +Z-direction. The first layer 21 is where the first flow channel member 30 and the third flow channel member 50 are melted together. The first layer 21 is provided along the XY plane and is formed when a surface of the first flow channel member 30 and a surface of the third flow channel member 50 that abut against each other in the +Z-direction are melted together by laser light used for laser bonding. In other words, the first layer 21 is formed when the −Z-direction-side surface of the first flow channel member 30 and the +Z-direction-side surface of the third flow channel member 50 are melted by laser light and mixed with each other. Thus, the first layer 21 is provided integrally with the first flow channel member 30 and the third flow channel member 50, such that the first flow channel member 30 and the third flow channel member 50 are fixed to each other via the first layer 21. Note that what is meant by the first layer 21 being provided along the XY plane is that the principle surface of the first layer 21 extends in a direction along the XY plane. In other words, the first layer 21 is formed to have substantially the same Z-axis thickness along the XY plane.

In addition, the second layer 22 is provided on the −Z-direction side of the second flow channel member 40 located outside the opening 105*a* of the gap 105 when the flow channel member 20 is seen in the +Z-direction. The second layer 22 is where the second flow channel member 40 and the third flow channel member 50 are melted together. The second layer 22 is provided along the XY plane and is formed when a surface of the second flow channel member 40 and a surface of the third flow channel member 50 that abut against each other in the +Z-direction are melted by laser light used for laser bonding. In other words, the second layer 22 is formed when the −Z-direction-side surface of the second flow channel member 40 and the +Z-direction-side surface of the third flow channel member 50 are melted by laser light and mixed with each other. Thus, the second layer 22 is provided integrally with the second flow channel member 40 and the third flow channel member 50, such that the second flow channel member 40 and the third flow channel member 50 are fixed to each other via the second layer 22. Note that what is meant by the second layer 22 being provided along the XY plane is that the principle surface of the second layer 22 extends in a direction along the XY plane. In other words, the second layer 22 is formed to have substantially the same Z-axis thickness along the XY plane. As mentioned earlier, the first layer 21 and the second layer 22 are provided extending in the same in-plane direction along the XY plane.

The first layer 21 and the second layer 22 are formed adjacently with the opening 105*a* of the gap 105 interposed therebetween when seen in the +Z-direction. What is meant by the first layer 21 and the second layer 22 being formed adjacently with the opening 105*a* interposed therebetween is that the first layer 21 and the second layer 22 are disposed adjacently two-dimensionally in the XY plane with the opening 105*a* interposed therebetween. The first layer 21 and the second layer 22 are provided along the XY plane which is the same plane direction. What is meant by the first layer 21 and the second layer 22 being provided along the same plane direction is that the principle surfaces of the first layer 21 and the second layer 22 extend along the XY plane. As long as the first layer 21 and the second layer 22 are provided along the XY plane which is the same plane direction, the first layer 21 and the second layer 22 may be provided at positions different in the +Z-direction, which is a direction normal to the XY plane. In other words, the first layer 21 and the second layer 22 may be provided parallel to each other. In the present embodiment, the first layer 21 and the second layer 22 are provided on substantially the same plane. What is meant by the first layer 21 and the second layer 22 being provided on substantially the same plane is that the first layer 21 and the second layer 22 are at the same positions in terms of the +Z-direction. Also, what is meant by the first layer 21 and the second layer 22 being provided on substantially the same plane is that the first layer 21 and the second layer 22 are provided at positions such that they overlap each other at least partially when seen in a direction along the XY plane. In other words, what is meant by the first layer 21 and the second layer 22 being provided on substantially the same plane includes their respective principle surfaces being not provided at the same positions in terms of the +Z-direction as long as they are provided at the same positions in terms of the +Z-direction at least partially. Also, in the present embodiment, the first layer 21 and the second layer 22 are made integral with each other by being melted together partially. It goes without saying that the first layer 21 and the second layer 22 may be provided separately. Note that what is meant by the first layer 21 and the second layer 22 being formed adjacently with the opening 105*a* of the gap 105 interposed therebetween when seen in the +Z-direction is that the first layer 21 is disposed on one side of the opening 105*a* of the gap 105 and the second layer 22 is disposed on the other side thereof when seen in the +Z-direction, and includes a mode where the first layer 21 and the second layer 22 are melted together and integral with each other at a position facing the opening 105*a* of the gap 105 in the +Z-direction.

Since the first flow channel member 30 is thus fixed to the third flow channel member 50 via the first layer 21 and the second flow channel member 40 is thus fixed to the third flow channel member 50 via the second layer 22, the first flow channel member 30 and the second flow channel member 40 can be fixed to each other via the third flow channel member 50.

In a fixed state where the first flow channel member 30, the second flow channel member 40, and the third flow channel member 50 are fixed together, the gap 105 is closed by the third flow channel member 50, and thus the opening 105*a* of the gap 105 is not open to the outside of the flow channel member 20. Thus, in this fixed state, the opening 105*a* of the gap 105 refers to a portion of the gap 105 which is located at the border between the gap 105 and the third flow channel member 50. Also, in the fixed state, the opening 105*a* of the gap 105 may define the border between the gap 105 and any one of the first layer 21, the second layer 22, and a layer formed by the first layer 21 and the second layer 22 melted together. Thus, in such a case, the opening 105*a* of the gap 105 refers to a portion located at the border between the gap 105 and any of the above layers.

Also, what is meant by "the third flow channel member 50 closes the opening 105*a*, at the −Z-direction side, of the gap 105 between the first flow channel member 30 and the second flow channel member 40" may include the third flow channel member 50 itself closing the opening 105*a* or the third flow channel member 50 closing the opening 105*a* indirectly with the opening 105*a* being closed by any one of the first layer 21, the second layer 22, and a layer formed by the first layer 21 and the second layer 22 melted together.

The first flow channel member 30 and the second flow channel member 40 are formed of a material non-transmissive of ultraviolet light and absorbent of laser light used for the laser bonding, and the third flow channel member 50 is formed of a material transmissive of laser light used for the laser bonding. This enables laser light used for the laser bonding to pass through the third flow channel member 50, so that the laser light passing through the third flow channel member 50 can be used for laser bonding to bond the third flow channel member 50 to the first flow channel member 30 and the second flow channel member 40.

Ultraviolet light is electromagnetic waves having a wavelength of 10 nm or greater and 400 nm or less. What is meant by the first flow channel member 30 and the second flow channel member 40 not transmitting ultraviolet light is that they have a transmittance such that ultraviolet light passing through the first flow channel member 30 and the second flow channel member 40 does not cure an ultraviolet light curable ink flowing in the flow channel in the flow channel member 20. Favorably, the ultraviolet light transmittance of the first flow channel member 30 and the second flow channel member 40 is less than 10%, preferably less than 3%, or more preferably 1%. Details will be given later of the ultraviolet light curable ink.

The laser light is laser light for resin used for laser bonding, and examples thereof include fiber laser light [wavelength: 1070 nm], yttrium aluminum garnet (YAG) laser light [wavelength: 1064 nm], and a laser diode (LD) [808 nm, 840 nm, 940 nm]. Other examples include semiconductor laser [wavelength: 635 nm to 940 nm], Nd:YAG laser light [wavelength: 1060 nm], and $CO_2$ laser light [wavelength: 9600 nm, 10,600 nm].

What is meant by the first flow channel member 30 and the second flow channel member 40 absorbent of laser light is that the first flow channel member 30 and the second flow channel member 40 are made of a material having a lower laser light transmittance than the third flow channel member 50 and being able to bond to the third flow channel member 50 by generating heat upon application of laser light. Thus, the first flow channel member 30 and the second flow channel member 40 are not limited to materials having laser light absorbance of 100%, but may be made of materials with an absorbance of less than 100%.

Also, preferably, the first flow channel member 30 and the second flow channel member 40 do not transmit visible light. Visible light here is electromagnetic waves having a wavelength of 360 nm or greater and 830 nm or less. What is meant by the first flow channel member 30 and the second flow channel member 40 not transmitting visible light is that they have a transmittance such that visible light passing through the first flow channel member 30 and the second flow channel member 40 does not cure an ultraviolet light curable ink flowing in the flow channel in the flow channel member 20. Favorably, the visible light transmittance of the first flow channel member 30 and the second flow channel member 40 is less than 10%, preferably less than 3%, or more preferably less than 1%.

Also, what is meant by the third flow channel member 50 being transmissive of laser light is that the third flow channel member 50 has a laser light transmittance of, for example, 15% or higher, preferably 20% or higher, or more preferably 30% or higher. In other words, what is meant by the third flow channel member 50 being transmissive of laser light is that the third flow channel member 50 is not limited to having a transmittance of 100% but may have a transmittance of less than 100%. Note that the third flow channel member 50 has a higher ultraviolet light transmittance than the first flow channel member 30 and the second flow channel member 40.

Examples of a material for the flow channel member 20 that enables such laser bonding include polypropylene (PP) resin, polybutylene terephthalate (PBT) resin, polyethylene terephthalate (PET) resin, and polyphenylene sulfide (PPS) resin.

The first flow channel member 30 and the second flow channel member 40 being absorbent of laser light can be formed by, for example, adding a black pigment such as carbon black to the above-described resin.

Also, the first flow channel member 30 and the second flow channel member 40 non-transmissive of ultraviolet light can be formed by a material containing an ultralight blocking agent that blocks ultraviolet light by absorbing or reflecting the ultraviolet light. In other words, examples of an ultraviolet light blocking agent include an ultraviolet light absorber that absorbs ultraviolet light and an ultraviolet light reflector that reflects ultraviolet light, and one of both of these can be used.

The ultraviolet light absorber may be, although not limited to, one or a combination of two or more of materials selected from triazine-based materials, benzophenone-based materials, benzotriazole-based materials, cyanoacrylate-based materials, salicylate-based materials, avobenzone-based materials, hindered amine-based materials, benzoylmethane-based materials, oxybenzone-based materials, cerium oxides, zinc oxides, and carbon black. Above all, triazine-based ultraviolet light absorbers are preferably used, and among the triazine-based ultraviolet light absorbers, an hydroxyphenyltriazine-based ultraviolet light absorber is more preferable.

Examples of the ultraviolet light reflector include titanium oxides, iron oxides, chrome oxides, lead oxides, zinc oxides, magnesium oxides, calcium carbonates, and barium sulfates, and one or a combination of two or more of the above can be used.

Note that some of the ultraviolet reflectors, such as, for example, chrome oxides and barium sulfates, may also function as an ultraviolet absorber.

The first flow channel member 30 has the first surface 33 opposite from the first layer 21 in terms of the Z-axis, and the second flow channel member 40 has the second surface 44 facing the first surface 33. The second surface 44 is provided with the bump portion 45 protruding toward the first surface 33. The bump portion 45 of the present embodiment is provided in a continuous annular form in the circumferential direction of the filter chamber 100 at a position inside the opening 105*a* of the gap 105 and outside the filter chamber 100 when seen in the +Z-direction. As will be detailed later, the bump portion 45 is such that the tip end thereof is crushed by the first surface 33 when the first flow channel member 30 is inserted into the third recess portion 43 and pressed in the +Z-direction in the manufacturing of the flow channel member 20. The bump portion 45 thus has a crushed tip by being pressed in contact with the first surface 33 and is therefore in close contact with the first flow channel member 30. Thus, the bump portion 45 functions as a seal portion that provides liquid-tightly sealing between the first flow channel member 30 and the second flow channel member 40 at a position inside the opening 105*a* of the gap 105. What is meant by the bump portion 45 being disposed inside the opening 105*a* of the gap 105 when seen in the +Z-direction includes the bump portion 45 being disposed at a position overlapping with the opening 105*a* when seen in the +Z-direction. More specifically, the bump portion 45 is disposed inside the opening 105*a*, including a position overlapping with the opening 105*a* of the gap 105 when seen in the +Z-direction.

Although the bump portion 45 is provided at the second surface 44 in the present embodiment, the present disclosure is not limited to this. For example, the first surface 33 may be provided with a bump portion protruding toward the second surface 44. Also, both of the first surface 33 and the second surface 44 may be provided with a bump portion. If the first surface 33 and the second surface 44 are both provided with a bump portion, the tips of the two bump portions may or may not abut against each other. If the two bump portions are disposed such that their tips do not abut against each other, two seal portions are formed by the two bump portions, thus improving the sealability. Also, although the bump portion 45 is provided in the continuous annular form here, the present disclosure is not limited to this. The bump portion does not have to be provided in the continuous annular form. Specifically, the bump portion may be provided discontinuously in the circumferential direction as multiple pieces at positions inside the opening 105*a* of the gap 105. When the bump portion is provided discontinuously as multiple pieces, the bump portion does not function as a seal portion. However, in the manufacturing of the flow channel member 20 to be detailed later, the surfaces of the first flow channel member 30 and the second flow channel member 40 fixed to the third flow channel member 50 can be aligned with each other in height, which enables laser bonding to be performed easily and accurately.

Also, since the first flow channel member 30 and the second flow channel member 40 of the flow channel member 20 are formed of a material non-transmissive of ultraviolet light as described above, an ultraviolet light curable ink can be used as an ink to flow through the flow channel in the flow channel member 20.

The ultraviolet light curable ink is, for example, an UV ink containing a monomer, an oligomer, or the like that undergoes polymerization and cures when irradiated with ultraviolet light. As the composition of the ultraviolet light curable ink, examples include inks that contain, as a polymerizable compound, any one of (meth)acrylates, (meth) acrylamides, and N-vinyl compounds.

Examples of monofunctional (meth)acrylate include hexyl (meth)acrylate, 2-ethylhexyl (meth)acrylate, tert-octyl (meth)acrylate, isoamyl (meth)acrylate, decyl (meth)acrylate, isodecyl (meth)acrylate, stearyl (meth)acrylate, isostearyl (meth)acrylate, cyclohexyl (meth)acrylate, 4-n-butylcyclohexyl (meth)acrylate, bornyl (meth)acrylate, isobornyl (meth)acrylate, benzil (meth)acrylate, 2-ethylhexyl diglycol (meth)acrylate, butoxyethyl (meth)acrylate, 2-chloroethyl (meth)acrylate, 4-bromobutyl (meth)acrylate, cyanoethyl (meth)acrylate, benzil (meth)acrylate, butoxymethyl (meth) acrylate, 3-methoxybutyl (meth)acrylate, alkoxymethyl (meth)acrylate, alkoxyethyl (meth)acrylate, 2-(2-methoxyethoxy) ethyl (meth)acrylate, 2-(2-butoxyethoxy) ethyl (meth)acrylate, 2,2,2-tetrafluoroethyl (meth)acrylate, 1H,1H,2H,2H-perfluorodecyl (meth)acrylate, 4-butylphenyl (meth)acrylate, phenyl (meth)acrylate, 2,4,5-tetramethylphenyl (meth)acrylate, 4-chlorophenyl (meth)acrylate, phenoxymethyl (meth)acrylate, phenoxyethyl (meth)acrylate, glycidyl (meth)acrylate, glycidyloxybutyl (meth)acrylate, glycidyloxyethyl (meth)acrylate, glycidyloxypropyl (meth)acrylate, tetrahydrofurfuryl (meth)acrylate, hydroxyalkyl (meth)acrylate, 2-hydroxyethyl (meth)acrylate, 3-hydroxypropyl(meth)acrylate, 2-hydroxypropyl(meth)acrylate, 2-hydroxybutyl(meth)acrylate, 4-hydroxybutyl(meth) acrylate, dimethylaminoethyl (meth)acrylate, diethylaminoethyl (meth)acrylate, dimethylaminopropyl (meth)acrylate, diethylaminopropyl (meth)acrylate, trimethoxysilylpropyl (meth)acrylate, dicyclopentenyl (meth)acrylate, dicyclopentenyloxyethyl (meth)acrylate, trimethylsilylpropyl (meth)acrylate, polyethylene oxide monomethyl ether (meth)acrylate, oligoethylene oxide monomethyl ether (meth)acrylate, polyethylene oxide (meth)acrylate, oligoethylene oxide (meth)acrylate, oligoethylene oxide monoalkyl ether (meth)acrylate, polyethylene oxide monoalkyl ether (meth)acrylate, dipropylene glycol (meth)acrylate, polypropylene oxide monoalkyl ether (meth)acrylate, oligopropylene oxide monoalkyl ether (meth)acrylate, 2-methacryloyloxyethyl succinic acid, 2-methacryloyloxyhexahydrophthalic acid, 2-methacryloyloxyethyl-2-hydroxypropyl phthalate, butoxydiethylene glycol (meth)acrylate, trifluoroethyl (meth)acrylate, perfluorooctylethyl (meth)acrylate, 2-hydroxy-3-phenoxypropyl (meth)acrylate, EO modified phenol (meth)acrylate, EO modified cresol (meth)acrylate, EO modified nonylphenol (meth)acrylate, PO modified nonylphenol (meth)acrylate, and EO modified-2-ethylhexyl (meth)acrylate.

As polyfunctional (meth)acrylate, examples of bifunctional (meth)acrylate include 1,6-hexanediol di(meth)acrylate, 1,10-decanediol di(meth)acrylate, neopentyl glycol di(meth)acrylate, dipropylene glycol di(meth)acrylate (DPG D(M)A), tripropylene glycol di(meth)acrylate (TPG D(M)A), 2,4-dimethyl-1,5-pentanediol di(meth)acrylate, butyl ethyl propanediol di(meth)acrylate, ethoxylated cyclohexane methanol di(meth)acrylate, triethylene glycol di(meth)acrylate (TEG D(M)A), polyethylene glycol di(meth) acrylate, oligoethylene glycol di(meth)acrylate, ethylene glycol di(meth)acrylate, 2-ethyl-2-butyl-butanediol di(meth)acrylate, hydroxypivalic acid neopentyl glycol di(meth) acrylate, dimethyloltricyclodecane di(meth)acrylate, EO modified bisphenol A di(meth)acrylate, bisphenol F polyethoxy di(meth)acrylate, polypropylene glycol di(meth) acrylate, oligopropylene glycol di(meth)acrylate, 1,4-butanediol di(meth)acrylate, 2-ethyl-2-butyl-propanediol di(meth)acrylate, 1,9-nonanediol di(meth)acrylate, propoxylated ethoxylated bisphenol A di(meth)acrylate, and tricyclodecane di(meth)acrylate.

As polyfunctional (meth)acrylate, examples of trifunctional (meth)acrylate include trimethylolpropane tri(meth) acrylate, trimethylolethane tri(meth)acrylate, trimethylolpropane alkylene oxide modified tri(meth)acrylate, pentaerythritol tri(meth)acrylate, dipentaerythritol tri(meth) acrylate, trimethylolpropane tri((meth)acryloyloxypropyl) ether, isocyanuric acid alkylene oxide modified tri(meth) acrylate, propionic acid dipentaerythritol tri(meth)acrylate, tri((meth)acryloyloxyethyl) isocyanurate, hydroxy pivalic aldehyde modified dimethylolpropane tri(meth)acrylate, sorbitol tri(meth)acrylate, propoxylated trimethylolpropane tri(meth)acrylate, and ethoxylated glycerine tri(meth)acrylate, examples of tetrafunctional (meth)acrylate include pentaerythritol tetra(meth)acrylate, sorbitol tetra(meth)acrylate, ditrimethylolpropane tetra(meth)acrylate, dipentaerythritol propionate tetra(meth)acrylate, and ethoxylated pentaerythritol tetra(meth)acrylate, examples of pentafunctional (meth)acrylate include sorbitol penta(meth)acrylate and dipentaerythritol penta(meth)acrylate, and examples of hexafunctional (meth)acrylate include dipentaerythritol hexa(meth)acrylate, sorbitol hexa(meth)acrylate, phosphazene alkylene oxide modified hexa(meth)acrylate, and caprolactone modified dipentaerythritol hexa(meth)acrylate.

Examples of the (meth)acrylamides include (meth)acrylamide, N-methyl (meth)acrylamide, N-ethyl (meth)acrylamide, N-propyl (meth)acrylamide, N-n-butyl (meth)acrylamide, N-t-butyl (meth)acrylamide, N-butoxymethyl (meth) acrylamide, N-isopropyl (meth)acrylamide, N-methylol (meth)acrylamide, N,N-dimethyl (meth)acrylamide, N,N-diethyl (meth)acrylamide, and (meth)acryloylmorpholine.

An N-vinyl compound has a structure in which a vinyl group is linked to nitrogen (>N—CH═$CH_2$). Specific examples of N-vinyl compounds include N-vinylformamide, N-vinylcarbazole, N-vinylindole, N-vinylpyrrole, N-vinylacetamide, N-vinylpyrrolidone, N-vinylcaprolactam, and derivatives thereof. Among these compounds, N-vinylcaprolactam is particularly preferable.

An ultraviolet light curable ink (UV ink) is an ink having the property of curing when irradiated with ultraviolet light [wavelength: 10 nm to 400 nm]. Typically, an ultraviolet light curable ink has the property of curing when irradiated with near-ultraviolet light [wavelength: 200 nm to 400 nm]. For example, an ultraviolet light curable ink has the property of curing when irradiated with near-ultraviolet A waves (UVA) [wavelength: 300 nm to 400 nm]. Alternatively, from the perspective of improving the ink preservability or reducing yellowing of the print material, an ultraviolet light curable ink may have the property of curing when irradiated with light having a wavelength of, for example, 380 nm or less or 350 nm or less.

Now, with reference to FIGS. 6 to 10, a description is given of a method for manufacturing the ink jet recording apparatus 1, or the flow channel member 20 in particular, of the present embodiment. FIGS. 6 to 10 are each a sectional view of the flow channel member 20, illustrating the method for manufacturing the flow channel member 20.

Figure 6:
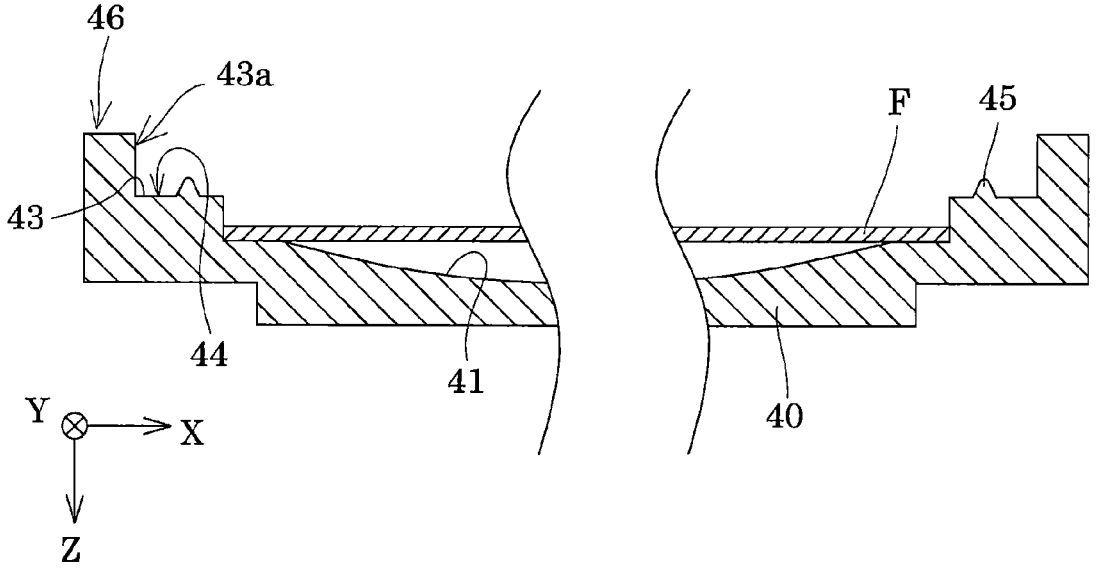
FIG. 6 is a sectional view showing a method for manufacturing the flow channel member according to Embodiment 1.

First, as shown in FIG. 6, the filter F is fixed to the second recess portion 41 of the second flow channel member 40. Examples of the method for fixing the filter F include bonding using an adhesive and thermal bonding. Note that the second flow channel member 40 used here already has the second recess portion 41, the third recess portion 43, the bump portion 45, the outflow channel 104, and the like. Such a second flow channel member 40 can be mass-produced inexpensively by, for example, injection molding of a resin material.

Figure 7:
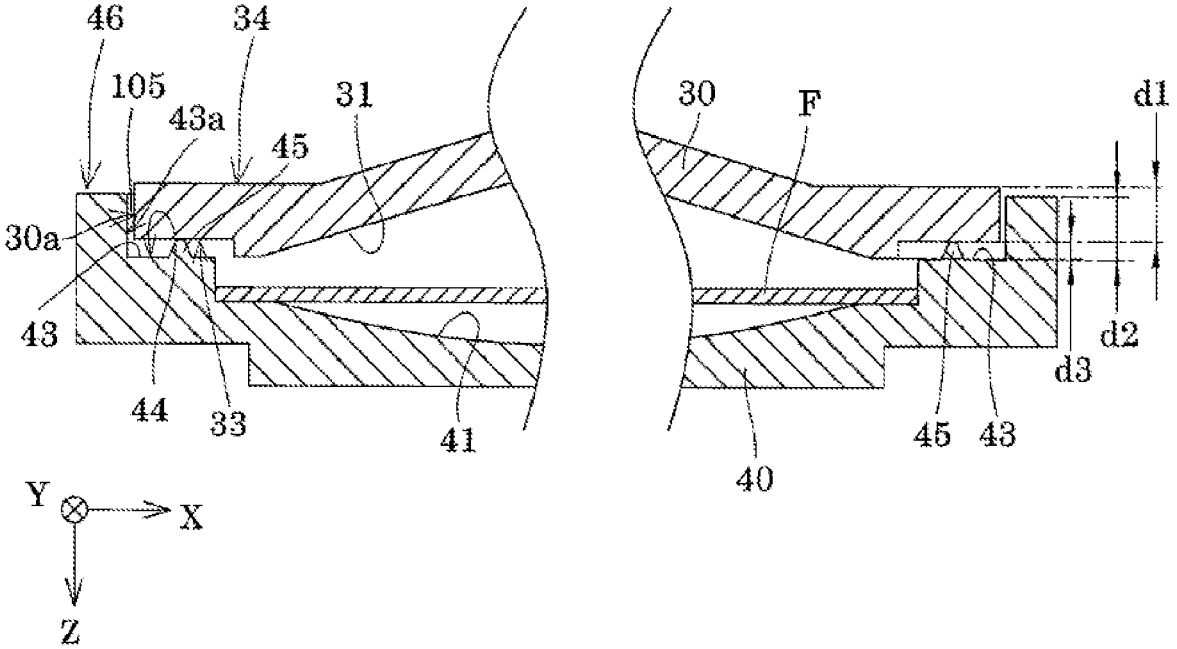
FIG. 7 is a sectional view showing the method for manufacturing the flow channel member according to Embodiment 1.

Next, as shown in FIG. 7, the first flow channel member 30 is inserted into the third recess portion 43 of the second flow channel member 40. The first flow channel member 30 already has the first recess portion 31, the inflow channel 103, and the like. Such a first flow channel member 30 can be mass-produced inexpensively by, for example, injection molding of a resin material.

The first flow channel member 30 is formed in dimensions such that the Z-axis thickness d1 of the portion of the first flow channel member 30 inserted into the third recess portion 43 is equal to or smaller than the depth d2 of the third recess portion 43 of the second flow channel member 40.

The thickness d1 of the portion of the first flow channel member 30 inserted into the third recess portion 43 is a dimension along the Z-axis between the +Z-direction-side first surface 33 and a first outer surface 34 of the portion inserted into the third recess portion 43, the first outer surface 34 being at the opposite side from the first surface 33 along the Z-axis and being a surface to which the third flow channel member 50 is to be fixed.

The depth d2 of the third recess portion 43 of the second flow channel member 40 is a dimension along the Z-axis from a second outer surface 46 to the second surface 44, the second outer surface 46 being located outside the third recess portion 43 of the second flow channel member 40 and being a surface to which the third flow channel member 50 is to be fixed.

A protrusion amount d3, which is an amount by which the bump portion 45 provided at the second surface 44 protrudes from the second surface 44 in the −Z-direction, is larger than the difference between the depth d2 of the third recess portion 43 of the second flow channel member 40 and the thickness d1 of the first flow channel member 30. Thus, d3>d2−d1.

Thus, as shown in FIG. 7, when the first flow channel member 30 is inserted into the third recess portion 43 of the second flow channel member 40 in the +Z-direction, the first outer surface 34 of the first flow channel member 30 protrudes more in the −Z-direction than the second outer surface 46 of the second flow channel member 40.

Figure 8:
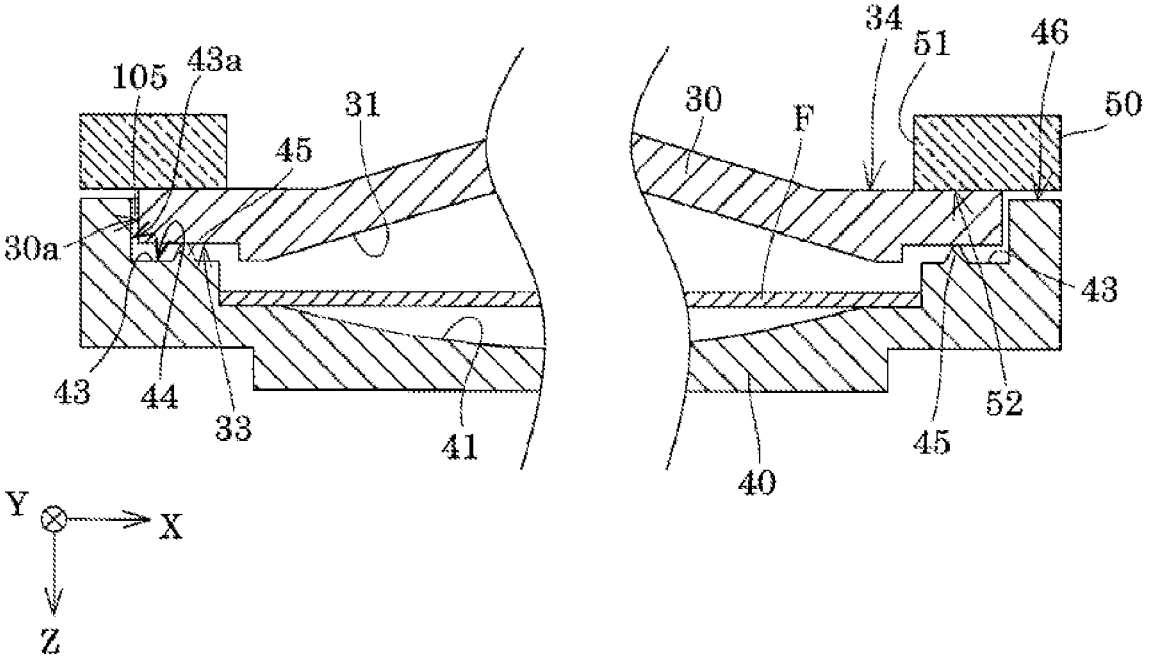
FIG. 8 is a sectional view showing the method for manufacturing the flow channel member according to Embodiment 1.

Next, as shown in FIG. 8, the third flow channel member 50 is placed in such a manner as to close the opening 105*a* of the gap 105 between the first flow channel member 30 and the second flow channel member 40, i.e., to extend onto the first outer surface 34 of the first flow channel member 30 and the second outer surface 46 of the second flow channel member 40 in a straddling manner. In the present embodiment, the +Z-direction-side surface of the third flow channel member 50 is referred to as a third outer surface 52. The third outer surface 52 is provided along the XY plane. Since the first outer surface 34 is located farther in the −Z-direction than the second outer surface 46, the third outer surface 52 abuts against only the first outer surface 34. The thickness of the third flow channel member 50, which is a dimension along the Z-axis, is uniform at all of the portion facing the first outer surface 34, the portion facing the opening 105*a* of the gap 105, and the portion facing the second outer surface 46. Thus, the third outer surface 52 of the third flow channel member 50 and the surface of the third flow channel member 50 opposite from the third outer surface 52 in terms of the Z-axis are each planar along the XY plane.

Figure 9:
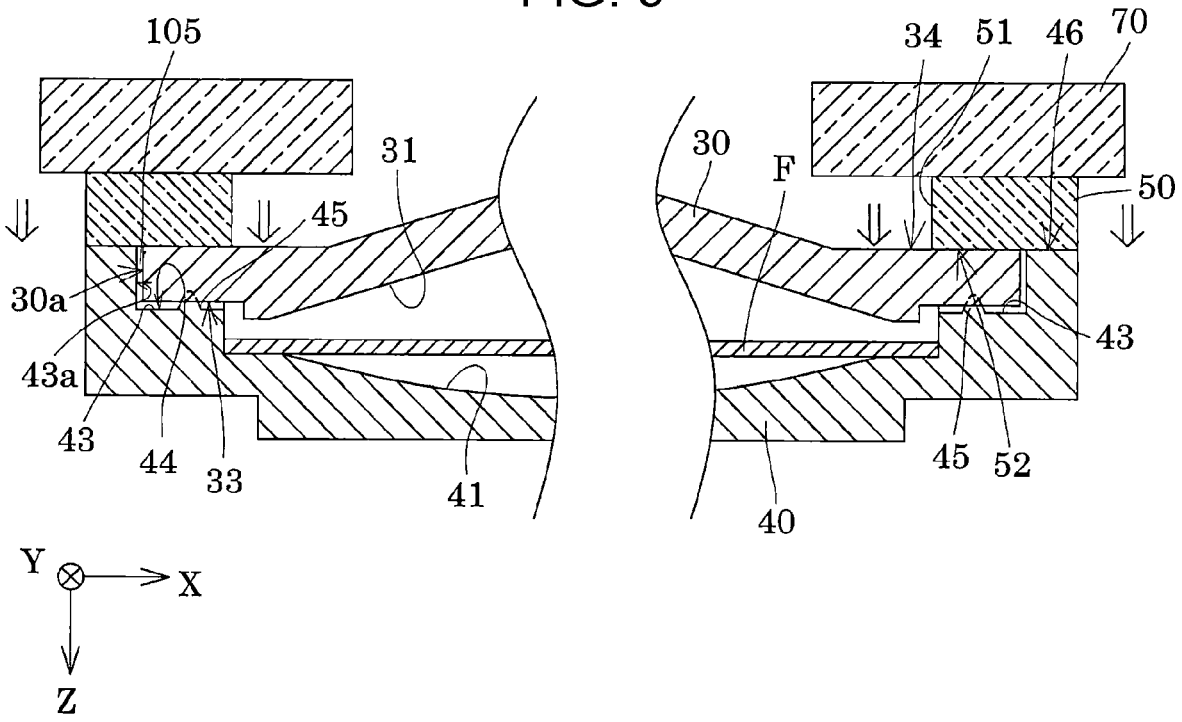
FIG. 9 is a sectional view showing the method for manufacturing the flow channel member according to Embodiment 1.

Next, as shown in FIG. 9, the −Z-direction-side surface of the third flow channel member 50 is pressed in the +Z-direction by a transmissive jig 70. In other words, a load is applied by the jig 70 to the third flow channel member 50. The transmissive jig 70 means that the jig 70 is, like the third flow channel member 50, transmissive of laser light used for the laser bonding. Specifically, favorably, the jig 70 has a laser light transmittance of 15% or higher, preferably 20% or higher, and more preferably 30% or higher. The jig 70 being transmissive of laser light is not limited to one having a transmittance of 100%, and may have a transmittance of less than 100%. For example, glass can be used for the jig 70.

By being pressed by the jig 70, the third flow channel member 50 presses the first flow channel member 30 in the +Z-direction, moving the first flow channel member 30 in the +Z-direction and consequently crushing the tip of the bump portion 45. Since the third outer surface 52 of the third flow channel member 50 is flush along the XY plane as described earlier, the tip of the bump portion 45 is crushed until the third outer surface 52 of the third flow channel member 50 abuts against the second outer surface 46 of the second flow channel member 40. As a result, the first outer surface 34 of the first flow channel member 30 and the second outer surface 46 of the second flow channel member 40 are brought to the same positions in terms of the +Z-direction, i.e., the first outer surface 34 and the second outer surface 46 are increased in their planarity and thus become flush with each other, so that the third outer surface 52 comes into close contact with the first outer surface 34 and the second outer surface 46 without any space formed therebetween. In other words, the first outer surface 34 of the first flow channel member 30 and the second outer surface 46 of the second flow channel member 40 are provided adjacently with the opening 105*a* of the gap 105 interposed therebetween, and the third flow channel member 50 is placed on top of the first outer surface 34 and the second outer surface 46. As a result, the third outer surface 52 of the third flow channel member 50 abuts against the first outer surface 34 and the second outer surface 46 in a straddling manner.

Figure 10:
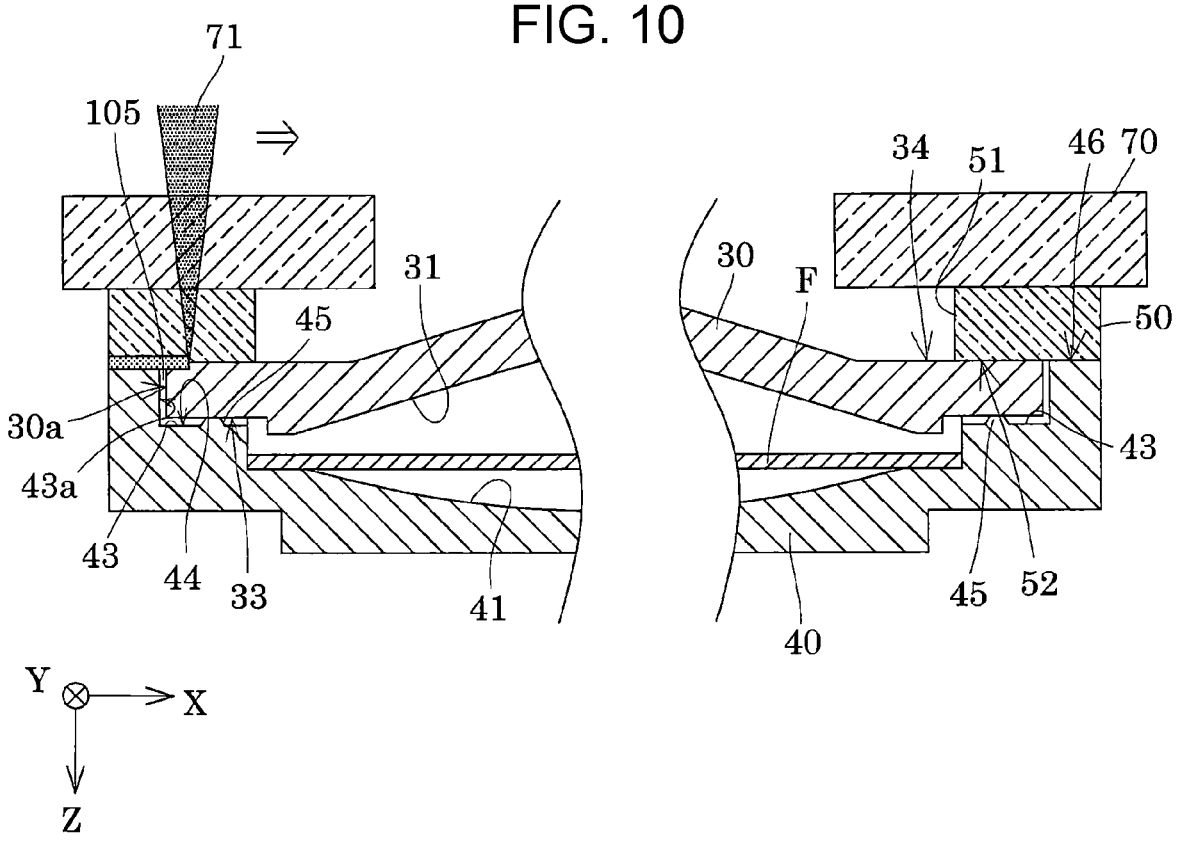
FIG. 10 is a sectional view showing the method for manufacturing the flow channel member according to Embodiment 1.

Next, as shown in FIG. 10, laser light 71 from a laser irradiation apparatus passes through the jig 70 and the third flow channel member 50 and is applied to the interface between the first outer surface 34 and the third outer surface 52 and the interface between the second outer surface 46 and the third outer surface 52 to perform laser bonding. As a result, the first layer 21 and the second layer 22 are formed, thereby fixing the third flow channel member 50 to the first flow channel member 30 and the second flow channel member 40.

To sum up, the first flow channel member 30 has the first outer surface 34 which is a portion of the outer surface of the first flow channel member 30. Also, the second flow channel member 40 has the second outer surface 46 which is a portion of the outer surface of the second flow channel member 40 and which faces the same direction as the first outer surface 34. The first outer surface 34 and the second outer surface 46 are provided adjacently with the opening 105*a* of the gap 105 interposed therebetween, and the third flow channel member 50 is placed on top of the first outer surface 34 and the second outer surface 46.

In this way, if the first flow channel member 30 and the second flow channel member 40 are made of a material non-transmissive of ultraviolet light and absorbent of laser light, the third flow channel member 50 transmissive of laser light can be laser-bonded to the first flow channel member 30 and the second flow channel member 40. Thus, the flow channel member 20 can be manufactured using laser bonding, without using an adhesive or outsert molding.

Since the portion of the third flow channel member 50 where laser light passes is uniform in thickness in the present embodiment as described above, the energy of laser light exerted can be the same for the interface between the first outer surface 34 and the third outer surface 52 and the interface between the second outer surface 46 and the third outer surface 52, allowing reduction in bonding unevenness, as opposed to when the portion of the third flow channel member 50 where laser light passes is non-uniform.

As described above, the flow channel member 20 of the present embodiment includes the first flow channel member 30 non-transmissive of ultraviolet light and absorbent of laser light. The flow channel member 20 also includes the second flow channel member 40 non-transmissive of ultraviolet light and absorbent of laser light, the second flow channel member 40 being stacked on the first flow channel member 30 to define the filter chamber 100 between itself and the first flow channel member 30 as a flow channel for ink as the liquid to flow. The flow channel member 20 also includes the third flow channel member 50 transmissive of laser light and fixed to the first flow channel member 30 and the second flow channel member 40 in such a manner as to close the opening 105*a* which is a gap between the first flow channel member 30 and the second flow channel member 40.

Even if an ultraviolet light curable ink flows in the flow channel in the flow channel member 20, using a material non-transmissive of ultraviolet light as the first flow channel member 30 and the second flow channel member 40 helps prevent the ultraviolet light curable ink flowing in the flow channel from being cured by ultraviolet light from outside.

Also, using a material absorbent of the laser light 71 as the first flow channel member 30 and the second flow channel member 40 and a material transmissive of the laser light 71 as the third flow channel member 50 allows the first flow channel member 30 and the third flow channel member 50 to be fixed to each other by laser bonding and the second flow channel member 40 and the third flow channel member 50 to be fixed to each other by laser bonding. A material transmissive of the laser light 71 is also transmissive of ultraviolet light. Thus, using a material absorbent of the laser light 71 as the first flow channel member 30 and the second flow channel member 40 allows the first flow channel member 30 and the second flow channel member 40 not to transmit ultraviolet light. Thus, the flow channel member 20 can be fixed by laser bonding without directly laser-bonding the first flow channel member 30 and the second flow channel member 40 to each other, i.e., without needing to form either one of the first flow channel member 30 and the second flow channel member 40 using a material transmissive of the laser light 71.

The first flow channel member 30, the second flow channel member 40, and the third flow channel member 50 are thus fixed by laser bonding, as opposed to a bonding structure in which, for example, the first flow channel member 30 and the second flow channel member 40 are bonded with an adhesive. Thus, ink leakage as a result of adhesive aging due to the compatibility between the adhesive and the ink can be avoided. Also, the structure of the present embodiment allows use of a hard-to-adhere material such as PP as the flow channel member 20.

Also, when the first flow channel member 30, the second flow channel member 40, and the third flow channel member 50 are fixed by laser bonding as opposed to, for example, an outsert structure in which the first flow channel member 30 and the second flow channel member 40 are fixed to each other with an outsert-molded third flow channel member, no exclusive designing of the mold is necessary, so that costs can be reduced and small-batch production is made possible. Also, as opposed to the outsert structure, the structure of the present embodiment can reduce cure shrinkage of resin at the time of molding, which in turn helps prevent warpage of the filter F so that the filter F used can have a large effective area. Also, since the structure of the present embodiment can reduce cure shrinkage of resin at the time of molding, there is no need to reduce the Z-axis height of the upstream chamber 101 or the downstream chamber 102 in order to provide a reinforcing boss for reducing the warpage of the filter F. This allows the filter chamber 100 to have a large volumetric capacity.

Also, the third flow channel member 50 is fixed in such a manner as to close the opening 105*a* of the gap 105 between the first flow channel member 30 and the second flow channel member 40. This can help prevent ink in the filter chamber 100, which is a flow channel formed between the first flow channel member 30 and the second flow channel member 40, from leaking to the outside through the gap 105.

Also, the flow channel member 20 of the present embodiment has the first layer 21 where the first flow channel member 30 and the third flow channel member 50 are melted together and the second layer 22 where the second flow channel member 40 and the third flow channel member 50 are melted together, and the first layer 21 and the second layer 22 are provided adjacently with the opening 105*a* of the gap 105 interposed therebetween and are preferably provided in the same plane direction.

Providing the first layer 21 and the second layer 22 in the same plane direction makes it unnecessary to switch the orientation of the laser light irradiation between when laser-bonding the first flow channel member 30 and the third flow channel member 50 and when laser-bonding the second flow channel member 40 and the third flow channel member 50. This means that the direction of the laser light irradiation can be the same for both and therefore simplifies the manufacturing process.

Also, in the flow channel member 20 of the present embodiment, the first layer 21 and the second layer 22 are preferably provided on substantially the same plane.

By thus providing the first layer 21 and the second layer 22 on substantially the same plane, when the third flow channel member 50 is laser-bonded to the first flow channel member 30 and the second flow channel member 40, surfaces abutting against each other can be brought into close contact with each other, allowing improvement in the bonding accuracy of the laser bonding.

In the flow channel member 20 of the present embodiment, the first flow channel member 30 has the first surface 33 opposite from the first layer 21, and the second flow channel member 40 has the second surface 44 facing the first surface 33. Then, at least one of the first surface 33 and the second surface 44 preferably has the bump portion 45 protruding to the other. In the present embodiment, the bump portion 45 is provided at the second surface 44. The bump portion 45 thus provided at the second surface 44 is crushed when the first flow channel member 30 is stacked on the second flow channel member 40. The bump portion 45 can thereby absorb variation in height due to the step between the first outer surface 34 and the second outer surface 46, helping prevent bonding failure between the third flow channel member 50 and each of the first flow channel member 30 and the second flow channel member 40.

Also, in the flow channel member 20 of the present embodiment, the bump portion 45 is preferably a seal portion that is annular when seen in the +Z-direction, which is the stacking direction of the first flow channel member 30 and the second flow channel member 40, and that provides liquid-tightly sealing between the first flow channel member 30 and the second flow channel member 40 at a position inside the opening 105*a* which is a gap. The bump portion 45 thus provided in the annular form to serve as a seal portion can help prevent ink in the flow channel in the flow channel member 20 from leaking to the outside through the opening 105*a*.

Also, in the flow channel member 20 of the present embodiment, the first flow channel member 30 and the second flow channel member 40 are preferably non-transmissive of visible light. The first flow channel member 30 and the second flow channel member 40 non-transmissive of visible light can help prevent liquid in the flow channel from reacting to visible light. This means that an ultraviolet light curable ink can be used as an ink to flow in the flow channel.

Also, in the flow channel member 20 of the present embodiment, when seen in the +Z-direction, which is the stacking direction of the first flow channel member 30 and the second flow channel member 40, the third flow channel member 50 preferably has a smaller area than the first flow channel member 30 and the second flow channel member 40. The third flow channel member 50 does not form a flow channel and therefore can be reduced in size. Reducing the size of the third flow channel member 50 enables reduction in costs.

The ink jet recording apparatus 1 which is an example of the liquid ejecting apparatus of the present embodiment includes the flow channel member 20 described above, the nozzles 11 that eject ink which is liquid supplied from the flow channel member 20, and the liquid reservoir 3 which is a liquid retainer that retains ink to be supplied to the flow channel member 20. According to this, ink supplied without being cured by ultraviolet light inside the flow channel member 20 can be ejected through the nozzles 11, and thus, ejection failure such as clogging of the nozzles 11 can be reduced.

Also, in the ink jet recording apparatus 1 of the present embodiment, the nozzles 11 preferably eject the ultraviolet light curable ink toward the target. According to this, ink supplied without being cured by ultraviolet light in the flow channel member 20 can be ejected through the nozzles 11, and thus, ejection failure such as clogging of the nozzles 11 can be reduced.

Also, the ink jet recording apparatus 1 of the present embodiment preferably includes the irradiator 7 that irradiates the medium S, which is the target, with ultraviolet light to cure the ultraviolet light curable ink attached to the medium S. The irradiator 7 thus provided allows the ultraviolet light curable ink on the medium S to be cured in a shorter amount of time by the irradiation of ultraviolet light by the irradiator 7. Even though ultraviolet light is applied to the flow channel member 20 from the irradiator 7, curing of the ultraviolet light curable ink in the flow channel in the flow channel member 20 can be reduced.

The method for manufacturing the ink jet recording apparatus 1 which is the liquid ejecting apparatus of the present embodiment is a method for manufacturing the ink jet recording apparatus 1 that includes the nozzles 11 that eject ink which is liquid and the flow channel member 20. The flow channel member 20 includes the first flow channel member 30 non-transmissive of ultraviolet light and absorbent of laser light. The flow channel members 20 also includes the second flow channel member 40 non-transmissive of ultraviolet light and absorbent of laser light, the second flow channel member 40 being stacked on the first flow channel member 30 to define a flow channel for ink to flow between itself and the first flow channel member 30. The flow channel member 20 also includes the third flow channel member 50 that is transmissive of laser light. Then, the third flow channel member 50 is fixed to the first flow channel member 30 and the second flow channel member 40 by laser bonding in such a manner as to close the opening 105*a* which is a gap between the first flow channel member 30 and the second flow channel member 40.

When the first flow channel member 30, the second flow channel member 40, and the third flow channel member 50 are thus fixed by laser bonding via the third flow channel member 50 transmissive of laser light, a material non-transmissive of ultraviolet light can be used as the first flow channel member 30 and the second flow channel member 40. Since the first flow channel member 30, the second flow channel member 40, and the third flow channel member 50 are thus fixed by laser bonding as opposed to, for example, a bonding structure in which the first flow channel member 30 and the second flow channel member 40 are bonded with an adhesive, ink leakage as a result of adhesive aging due to the compatibility between the adhesive and the ink can be avoided. Also, the structure of the present embodiment allows use of a hard-to-adhere material such as PP as the flow channel member 20.

Also, when the first flow channel member 30, the second flow channel member 40, and the third flow channel member 50 are fixed by laser bonding as opposed to, for example, an outsert structure in which the first flow channel member 30 and the second flow channel member 40 are fixed to each other with an outsert-molded third flow channel member, no exclusive designing of the mold is necessary, so that costs can be reduced and small-batch production is made possible. Also, as opposed to the outsert structure, the structure of the present embodiment can reduce cure shrinkage of resin at the time of molding, which in turn helps prevent warpage of the filter F so that the filter F used can have a large effective area. Also, since the structure of the present embodiment can reduce cure shrinkage of resin in the molding, there is no need to reduce the Z-axis height of the upstream chamber 101 or the downstream chamber 102 in order to provide a reinforcing boss for reducing the warpage of the filter F. This allows the filter chamber 100 to have a large volumetric capacity.

In the flow channel member 20 thus manufactured, the first flow channel member 30 and the second flow channel member 40 are formed of a material non-transmissive of ultraviolet light. Thus, even if an ultraviolet light curable ink flows in the flow channel in the flow channel member 20, the ultraviolet light curable ink flowing in the flow channel can be prevented from being cured by external ultraviolet light.

In the method for manufacturing the ink jet recording apparatus 1 of the present embodiment, the first flow channel member 30 has the first outer surface 34 which is a portion of the outer surface of the first flow channel member 30 and the first surface 33 opposite from the first outer surface 34. The second flow channel member 40 has the second surface 44 facing the first surface 33. At least one of the first surface 33 and the second surface 44 is provided with the bump portion 45 protruding to the other. Then, preferably, with the bump portion 45 being crushed by a load exerted to the third flow channel member 50 by the transmissive jig 70, laser light is applied to the first flow channel member 30 and the second flow channel member 40 via the jig 70 and the third flow channel member 50 to achieve bonding. Then, the first outer surface 34 and the second outer surface 46 can be laser-bonded while being brought to the same positions in the +Z-direction by the load applied by the jig 70. Thus, the bonding accuracy of the laser bonding can be improved.

Embodiment 2

Figure 11:
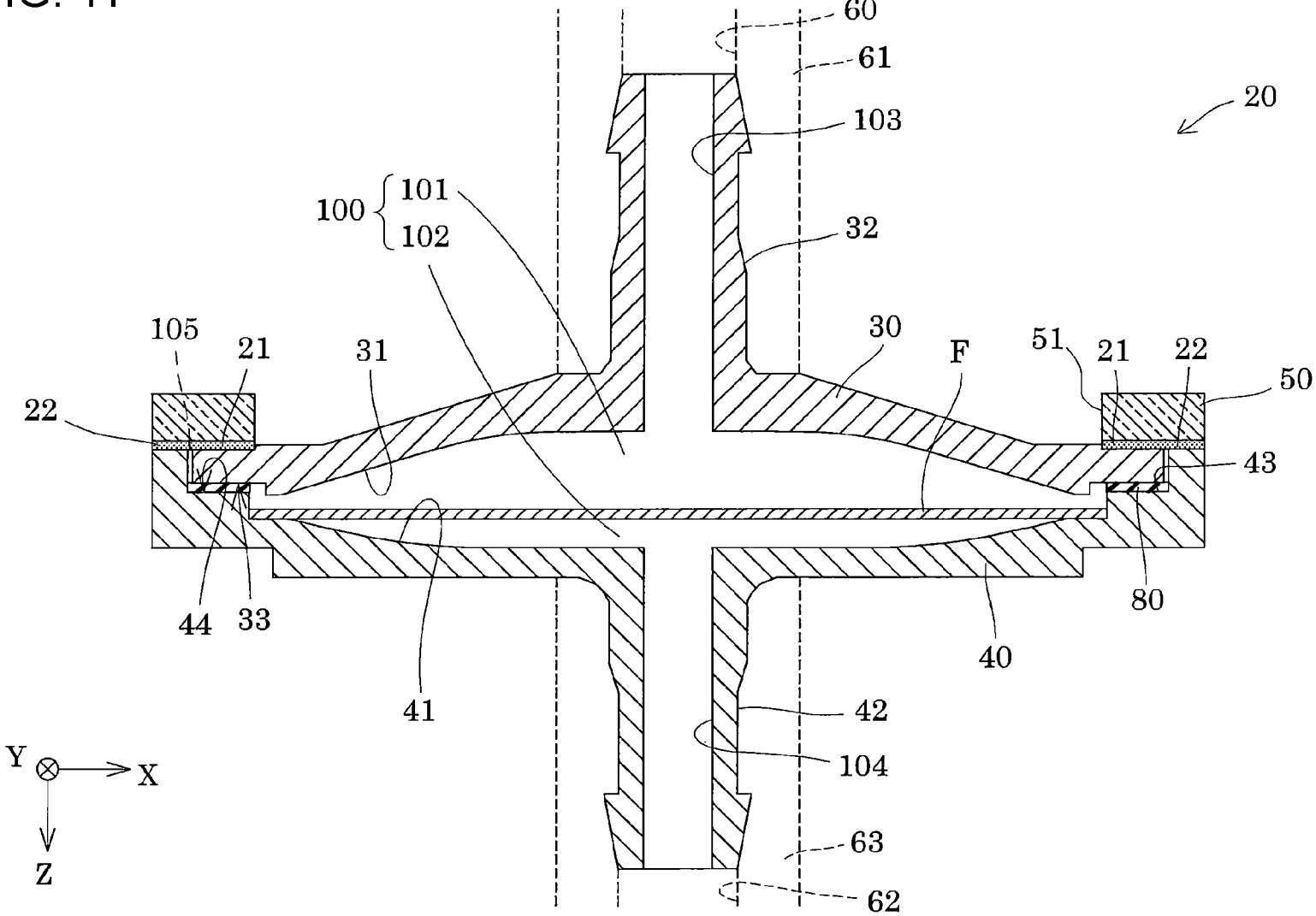
FIG. 11 is a sectional view of a flow channel member according to Embodiment 2.

FIG. 11 is a sectional view of a flow channel member according to Embodiment 2 of the present disclosure. The same members as those in the embodiment described above are denoted by the same reference numerals as those used in the above embodiment to avoid repetitive description.

As shown in FIG. 11, the flow channel member 20 of the present embodiment includes the first flow channel member 30, the second flow channel member 40, the third flow channel member 50, and a flexible member 80.

The bump portion 45 is not provided at the second surface 44 of the second flow channel member 40. In other words, the second surface 44 is a planar surface extending along the XY plane. Then, the flexible member 80 is disposed between the first surface 33 of the first flow channel member 30 and the second surface 44 of the second flow channel member 40.

The flexible member 80 is a material with flexibility and is made of, for example, rubber, elastomer, or the like. The flexible member 80 is annular when seen in the +Z-direction which is the stacking direction of the first flow channel member 30 and the second flow channel member 40. The flexible member 80 is disposed inside the opening 105*a* of the gap 105 when seen in the +Z-direction. What is meant by the flexible member 80 being disposed inside the opening 105*a* of the gap 105 when seen in the +Z-direction includes the flexible member 80 being disposed at a position overlapping with the opening 105*a* when seen in the +Z-direction. In other words, the flexible member 80 is disposed inside the opening 105*a*, including a position overlapping with the opening 105*a* of the gap 105 when seen in the +Z-direction.

With the first flow channel member 30 and the second flow channel member 40 being fixed to the third flow channel member 50, the flexible member 80 is pressed between the first surface 33 and the second surface 44 in directions in which the first surface 33 and the second surface 44 come toward each other along the Z-axis. In other words, the flexible member 80 is pressed by the first surface 33 in the +Z-direction and is pressed by the second surface 44 in the −Z-direction. In a state where the first flow channel member 30 and the second flow channel member 40 are not fixed to the third flow channel member 50, the Z-axis thickness of the flexible member 80 is larger than the difference between the thickness d1 of the portion of the first flow channel member 30 inserted into the third recess portion 43 and the depth d2 of the third recess portion 43 of the second flow channel member 40. Thus, like in Embodiment 1 described above, when a load is applied to the third flow channel member 50 by the jig 70 to press the first flow channel member 30 in the +Z-direction, the flexible member 80 is flexed and deformed, causing the first outer surface 34 of the first flow channel member 30 and the second outer surface 46 of the second flow channel member 40 to be the same in height in the +Z-direction and be flush with each other because the planarity is increased.

Also, the first layer 21 where the first flow channel member 30 and the third flow channel member 50 are melted together and the second layer 22 where the second flow channel member 40 and the third flow channel member 50 are melted together are provided on one side and on the other side of the opening 105*a* of the gap 105 between the first flow channel member 30 and the second flow channel member 40, respectively. The first flow channel member 30, the second flow channel member 40, and the third flow channel member 50 are fixed to one another by the first layer 21 and the second layer 22.

The flexible member 80 is held flexed and deformed between the first surface 33 and the second surface 44 by being pressed in directions in which the first surface 33 and the second surface 44 come toward each other along the Z-axis. Thus, the flexible member 80 serves also as a seal portion that provides liquid-tightly sealing between the first flow channel member 30 and the second flow channel member 40 at a position inside the opening 105*a* of the gap 105.

In other words, the flexible member 80 has two functions: 1) bringing the first outer surface 34 of the first flow channel member 30 and the second outer surface 46 of the second flow channel member 40 to equal height by flexing and deforming and 2) serving as a seal portion that provides sealing between the first flow channel member 30 and the second flow channel member 40.

To improve the sealability as a seal portion, it is also possible to provide the flexible member 80 with a bump shape protruding in the +Z-direction or the −Z-direction to make the flexible member 80 more easily deformable.

In the method for manufacturing the ink jet recording apparatus 1 of the present embodiment, the first flow channel member 30 has the first outer surface 34 which is a portion of the outer surface of the first flow channel member 30 and the first surface 33 opposite from the first outer surface 34. The second flow channel member 40 has the second surface 44 facing the first surface 33. A flexible member is disposed between the first surface 33 and the second surface 44. Then, preferably, with the flexible member being flexed by a load exerted to the third flow channel member 50 by the transmissive jig 70, laser light is applied to the first flow channel member 30 and the second flow channel member 40 via the jig 70 and the third flow channel member 50 to achieve bonding. Then, the first outer surface 34 and the second outer surface 46 can be laser-bonded while being brought to the same positions in the +Z-direction by the load applied by the jig 70. Thus, the bonding accuracy of the laser bonding can be improved.

As described above, in the flow channel member 20 of the present embodiment, the first flow channel member 30 has the first surface 33 opposite from the first layer 21, the second flow channel member 40 has the second surface 44 facing the first surface 33, and the flexible member 80 is disposed between the first surface 33 and the second surface 44. The first outer surface 34 and the second outer surface 46 to which the third flow channel member 50 is laser-bonded can be brought to equal height also by the flexible member 80, so that the bonding accuracy by the laser bonding can be improved.

Also, in the flow channel member 20 of the present embodiment, the flexible member 80 is preferably a seal portion that is annular when seen in the +Z-direction which is the stacking direction of the first flow channel member 30 and the second flow channel member 40 and provides liquid-tightly sealing between the first flow channel member 30 and the second flow channel member 40 at a position inside the opening 105*a* of the gap 105. Providing the annular flexible member 80 serving as a seal portion helps prevent ink in the flow channel in the flow channel member 20 from leaking to the outside through the opening 105*a*.

Embodiment 3

Figure 12:
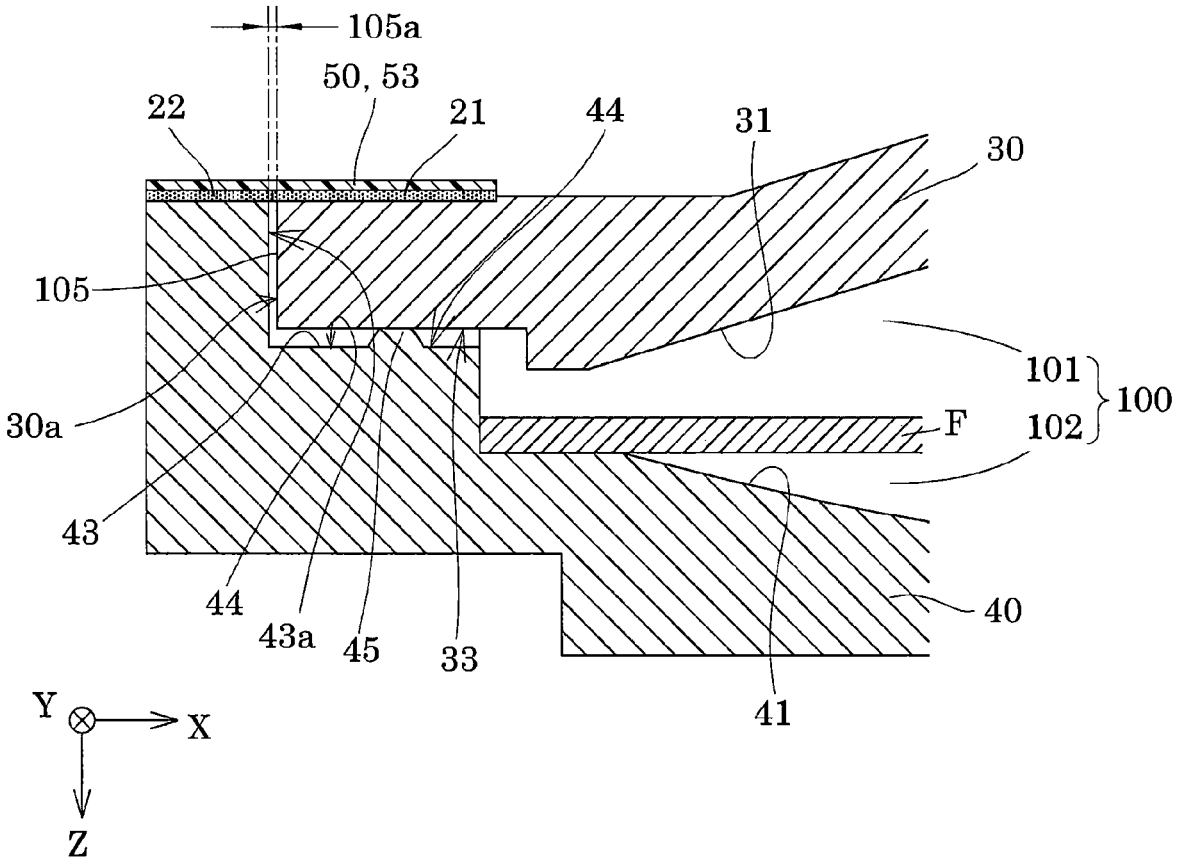
FIG. 12 is a sectional view enlarging a main portion of a flow channel member according to Embodiment 3.
Figure 13:
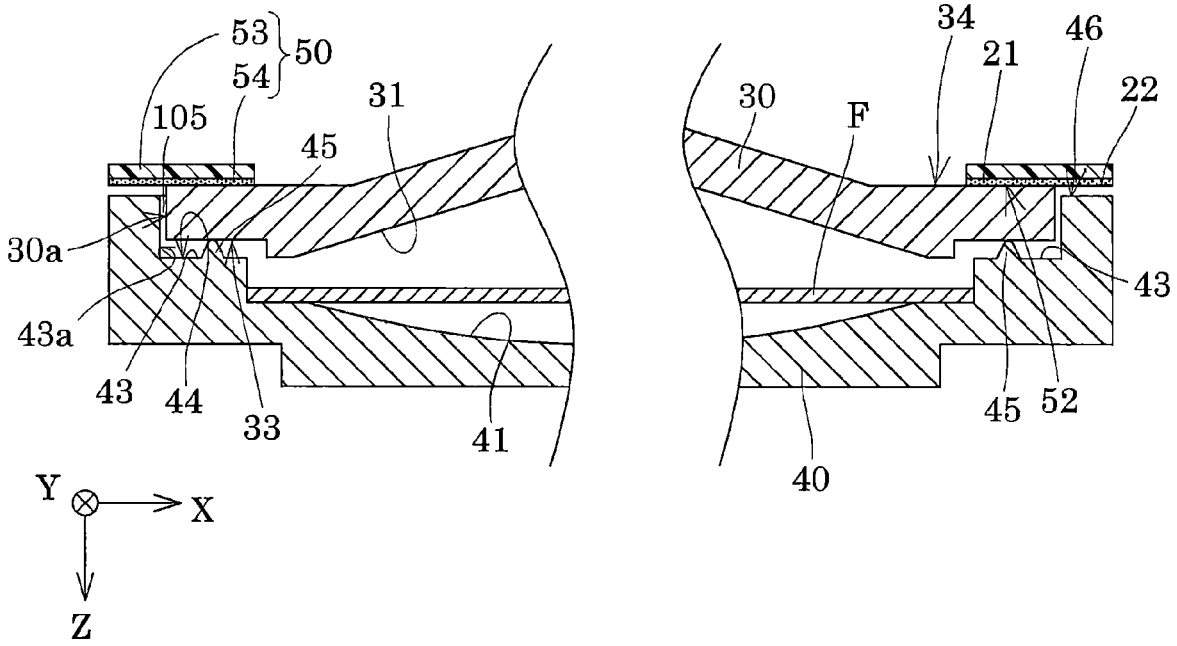
FIG. 13 is a sectional view showing a method for manufacturing the flow channel member according to Embodiment 3.
Figure 14:
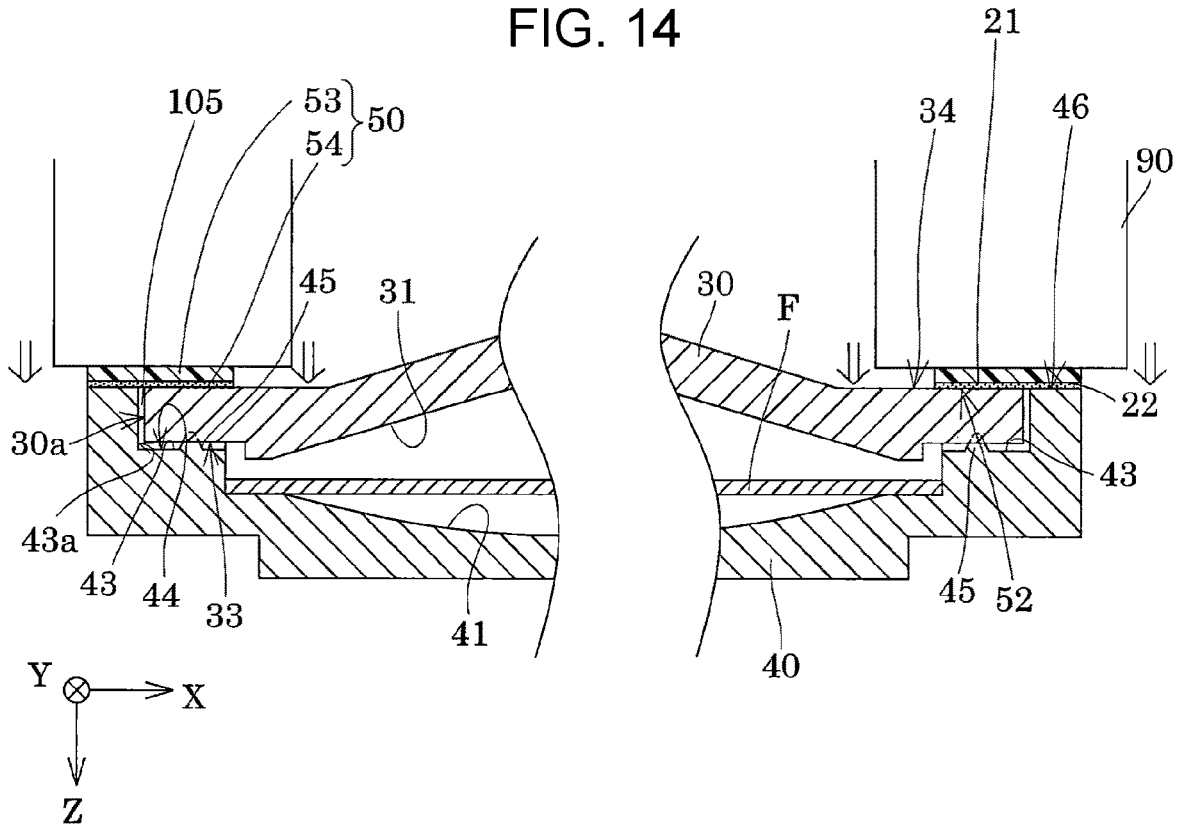
FIG. 14 is a sectional view showing the method for manufacturing the flow channel member according to Embodiment 3.
Figure 15:
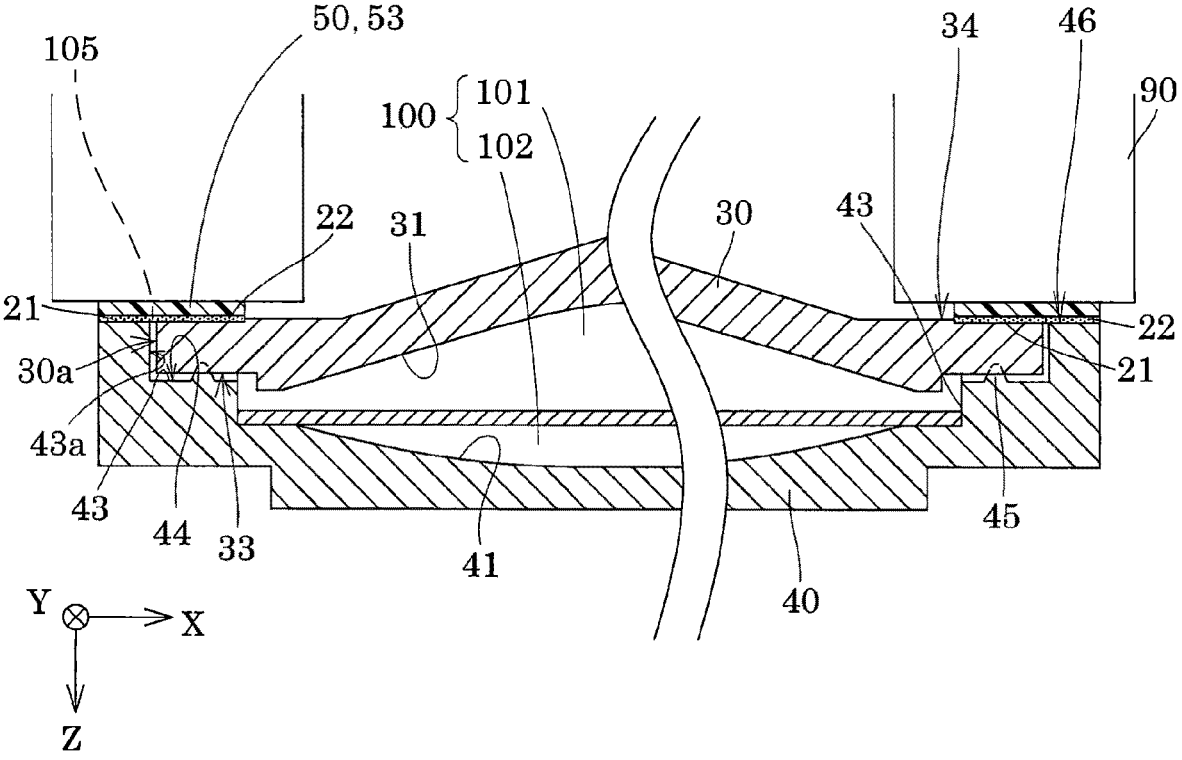
FIG. 15 is a sectional view showing the method for manufacturing the flow channel member according to Embodiment 3.

FIG. 12 is a sectional view of the flow channel member 20 according to Embodiment 3 of the present disclosure, taken along a line corresponding to line A-A. FIGS. 13 to 15 are sectional views of the flow channel member 20, illustrating a method for manufacturing the ink jet recording apparatus 1 of the present embodiment. Note that the same members as those in the above embodiments are denoted by the same reference numerals used in the above embodiments to avoid repetitive description.

As shown in FIG. 12, the flow channel member 20 includes the first flow channel member 30, the second flow channel member 40, and the third flow channel member 50.

The first flow channel member 30 and the second flow channel member 40 are the same as those in Embodiment 1 described above and are therefore not described here to avoid repetition.

The third flow channel member 50 has a film-like base material 53. The base material 53 may be a material that is absorbent of laser light used for laser bonding. The third flow channel member 50 may have part of a bonding layer 54 used for thermal bonding remaining on the +Z-direction side of the base material 53.

The third flow channel member 50 thus configured is provided straddling the opening 105*a* of the gap 105 between the first flow channel member 30 and the second flow channel member 40. Further, the first layer 21 is formed between a portion of the third flow channel member 50 and the first flow channel member 30, the position being inside the opening 105*a* of the gap 105, and the second layer 22 is formed between a portion of the third flow channel member 50 and the second flow channel member 40, the portion being outside the opening 105*a* of the gap 105. The third flow channel member 50 is bonded to the first flow channel member 30 and the second flow channel member 40 by thermal bonding, and the first layer 21 and the second layer 22 are formed by the thermal bonding. In other words, the first layer 21 and the second layer 22 are formed when a portion of the third flow channel member 50 on the pre-bonded third outer surface 52 side is melted and mixed with a portion of the first flow channel member 30 on the pre-bonded first outer surface 34 side and with a portion of the second flow channel member 40 on the pre-bonded second outer surface 46 side, respectively.

As shown in FIG. 13, before being joined to the first flow channel member 30 and the second flow channel member 40, the third flow channel member 50 is formed by the film-like base material 53 and the bonding layer 54 stacked in this order in the +Z-direction. The base material 53 is a material having a higher melting temperature than the bonding layer 54 and difficult to be melted by a heat tool 90 to be described in detail later, and for example, polyethylene terephthalate (PET) resin can be used. The bonding layer 54 is a material having a lower melting temperature than the base material 53 and easily melted by the heat tool 90, and for example, polypropylene (PP) resin can be used.

Now, a description is given of the method for manufacturing the ink jet recording apparatus 1 or particularly the flow channel member 20.

First, after the same steps as those in Embodiment 1 above in FIGS. 6 and 7 are performed, the third flow channel member 50 is placed on top of the first outer surface 34 and the second outer surface 46 as shown in FIG. 13.

Next, as shown in FIG. 14, the heat tool 90 is used to press the third flow channel member 50 in the +Z-direction. In other words, a load is applied to the third flow channel member 50 by the heat tool 90. When the heat tool 90 is thus used to apply a load to the third flow channel member 50, the first flow channel member 30 moves in the +Z-direction, crushing the tip of the bump portion 45 to cause the first outer surface 34 and the second outer surface 46 to be at the same positions in terms of the +Z-direction, i.e., to be flush with each other.

Next, as shown in FIG. 15, with the first outer surface 34 and the second outer surface 46 being flush with each other, the base material 53 side of the third flow channel member 50 is heated with the heat tool 90, so that the bonding layer 54 of the third flow channel member 50 is melted with the first outer surface 34 of the first flow channel member 30 and with the second outer surface 46 of the second flow channel member 40. As a result, the first layer 21 is formed between the first flow channel member 30 and the third flow channel member 50, and the second layer 22 is formed between the second flow channel member 40 and the third flow channel member 50, to fix the first flow channel member 30, the second flow channel member 40, and the third flow channel member 50 to one another.

The above configuration also allows a material non-transmissive of ultraviolet light to be used as the first flow channel member 30 and the second flow channel member 40, and therefore an ultraviolet light curable ink can be used as the ink.

Other Embodiments

Embodiments of the present disclosure have thus been described, but the basic configuration of the present disclosure is not limited to the above.

Figure 16:
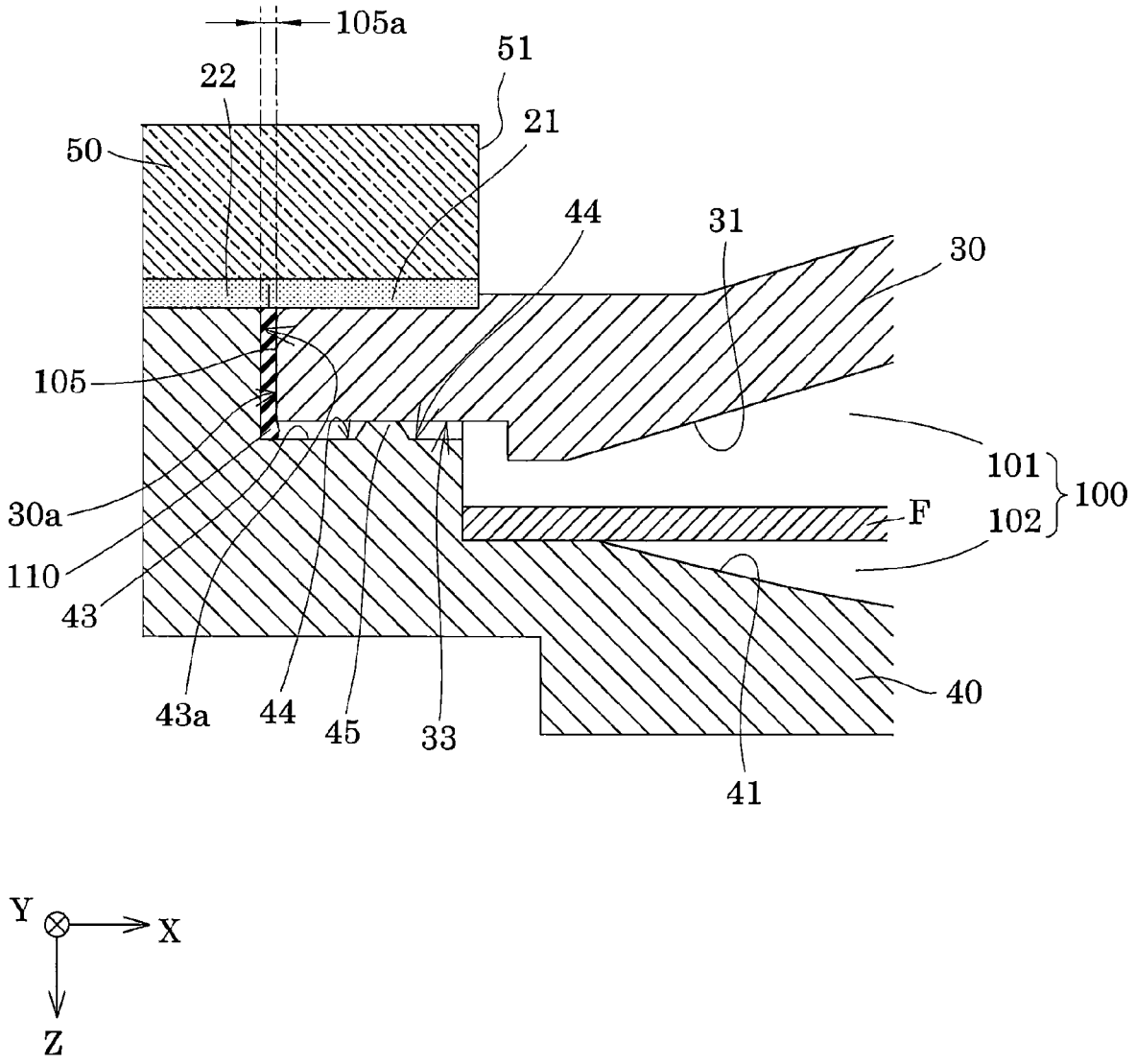
FIG. 16 is a sectional view enlarging a main portion of a flow channel member according to another embodiment.

Although the flow channel in the flow channel member 20 in the above embodiments is sealed by the bump portion 45 or the flexible member 80, the present disclosure is not limited to this. For example, the flow channel member 20 may include, besides the bump portion 45 or the flexible member 80, a seal portion that provides sealing between the first flow channel member 30 and the second flow channel member 40, at a position inside the opening 105*a* of the gap 105 when seen in the +Z-direction which is the "stacking direction" of the first flow channel member 30 and the second flow channel member 40. FIG. 16 shows a modification of the flow channel member 20.

As shown in FIG. 16, a seal portion 110 formed of rubber or elastomer is provided in the gap 105. More specifically, the seal portion 110 is provided, sandwiched between the outer circumferential surface 30*a* of the first flow channel member 30 and the side surface 43*a* of the third recess portion 43 under a predetermined pressure. The seal portion 110 is provided in a continuous annular form throughout the gap 105, i.e., throughout the outer circumference of the filter chamber 100. What is meant by the seal portion 110 being provided inside the opening 105*a* means that the seal portion 110 is disposed inward, i.e., on the filter chamber 100 (flow channel) side, of the opening 105*a*. Thus, the seal portion 110 being provided inside the opening 105*a* includes a configuration in which the seal portion 110 is provided in the gap 105 and a configuration in which the seal portion 110 is provided off the gap 105, and thus, includes the seal portion 110 being provided at a position overlapping with the opening 105*a* of the gap 105 when seen in the +Z-direction, as shown in FIG. 16. When thus provided inside the opening 105*a*, the seal portion 110 can help prevent ink in the filter chamber 100 from leaking to the outside through the opening 105*a*. The seal portion 110 can also help prevent ink in the flow channel from being irradiated with ultraviolet light and thus help prevent an ultraviolet light curable ink in the flow channel from curing. It goes without saying that if the seal portion 110 is provided in addition to the bump portion 45 or the flexible member 80 described above serving as a seal portion, double sealing can be provided, which can further help prevent ink in the filter chamber 100 from leaking to the outside and also help prevent ink in the flow channel from being irradiated with ultraviolet light or visible light.

Also, the flow channel member 20 is not limited to the configurations described in the above embodiments. FIGS. 17 to 22 show modifications of the flow channel member 20. FIGS. 17, 18, 20, 21, and 22 are sectional views illustrating the modifications of the flow channel member 20, taken along a line corresponding to line A-A in FIG. 3. FIG. 19 is a plan view of FIG. 18. The same members as those in the embodiments described above are denoted by the same reference numerals as those used in the above embodiments to avoid repetitive description.

Figure 17:
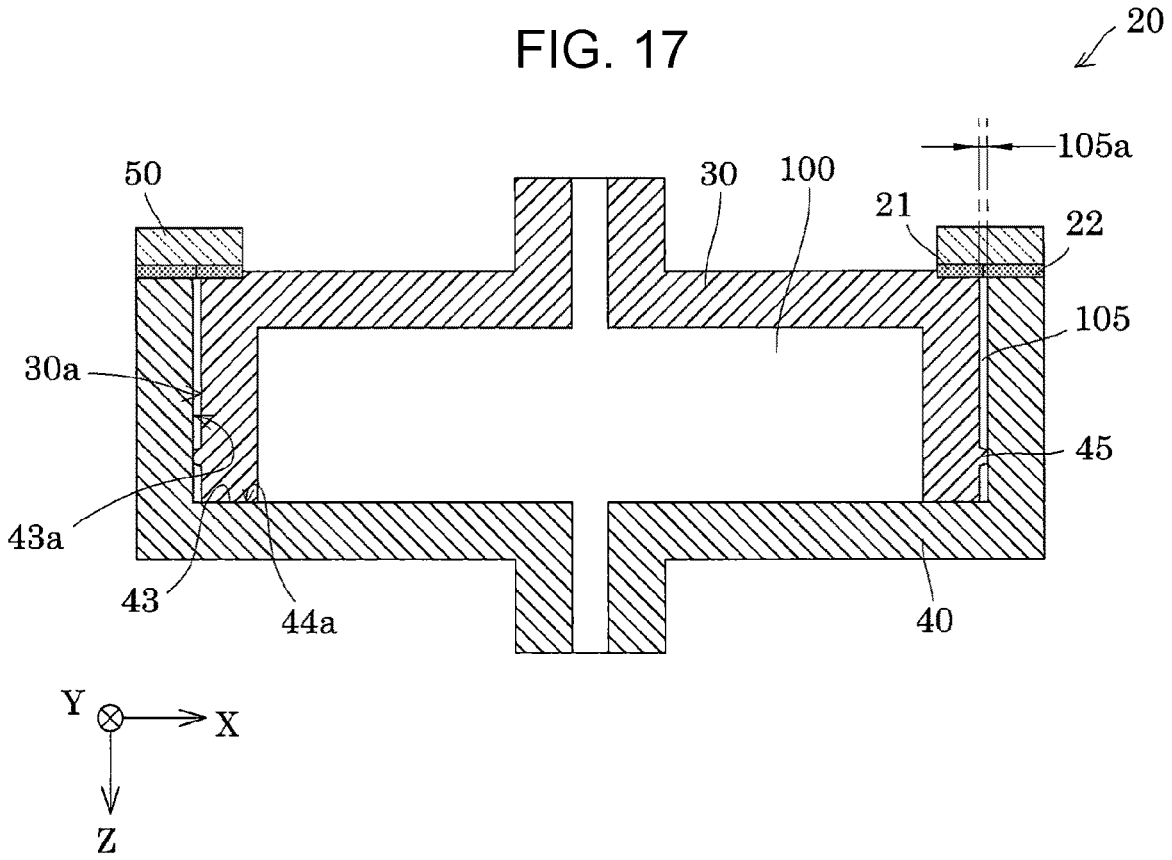
FIG. 17 is a sectional view of the flow channel member according to the another embodiment.

As shown in FIG. 17, the first flow channel member 30 is inserted into the third recess portion 43 of the second flow channel member 40. The bump portion 45 is provided at the outer circumferential surface 30*a* of the first flow channel member 30, serving as a seal portion by being in contact with the side surface 43*a* of the third recess portion 43 of the second flow channel member 40. The gap 105 is provided between the outer circumferential surface 30*a* of the first flow channel member 30 and the side surface 43*a* of the third recess portion 43 of the second flow channel member 40, and the third flow channel member 50 is fixed to the first flow channel member 30 and the second flow channel member 40 in such a manner as to close the opening 105*a* of the gap 105 at the −Z-direction side.

The first layer 21 and the second layer 22 where the third flow channel member 50 is melted with the first flow channel member 30 and with the second flow channel member 40, respectively, are provided adjacently with the opening 105*a* interposed therebetween and are provided on substantially the same plane. In such a configuration as well, the bump portion 45 is provided inside the opening 105*a*, including a position overlapping with the opening 105*a* when seen in the +Z-direction, and can serve as a seal portion.

Figure 18:
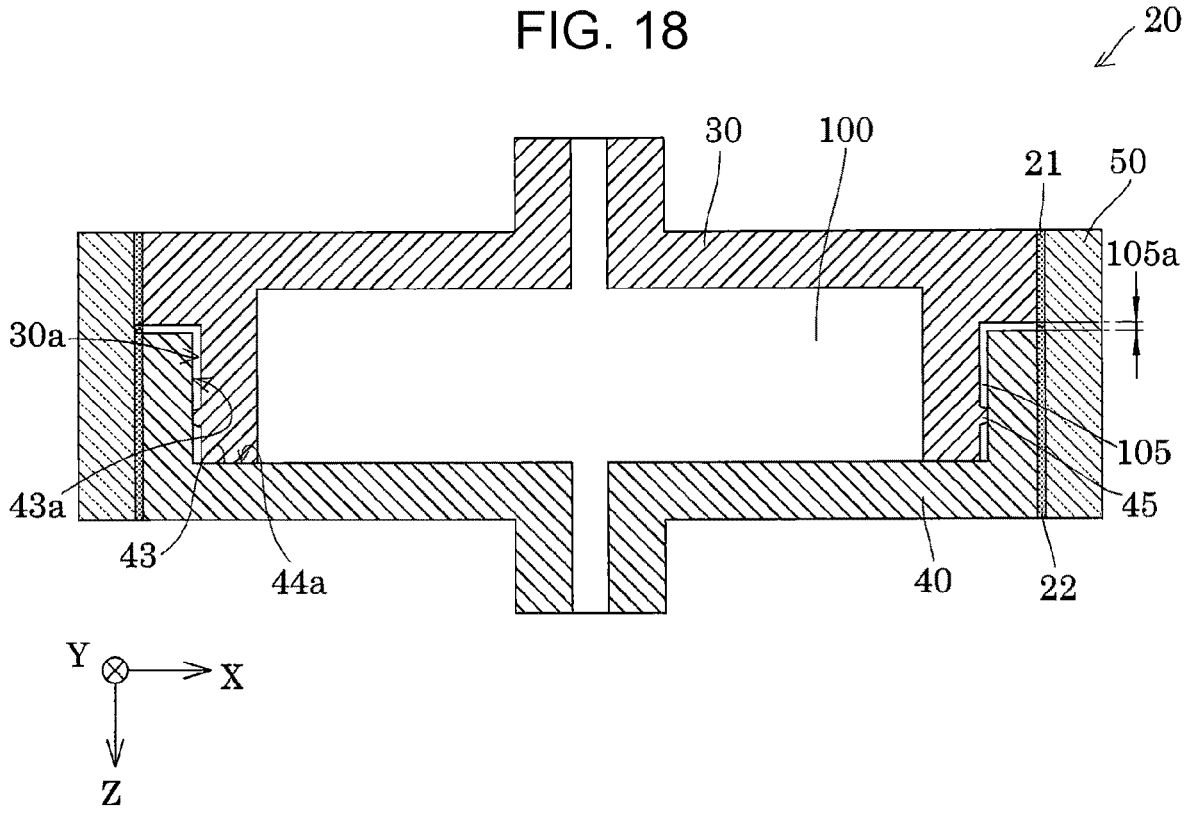
FIG. 18 is a sectional view of a flow channel member according to yet another embodiment.
Figure 19:
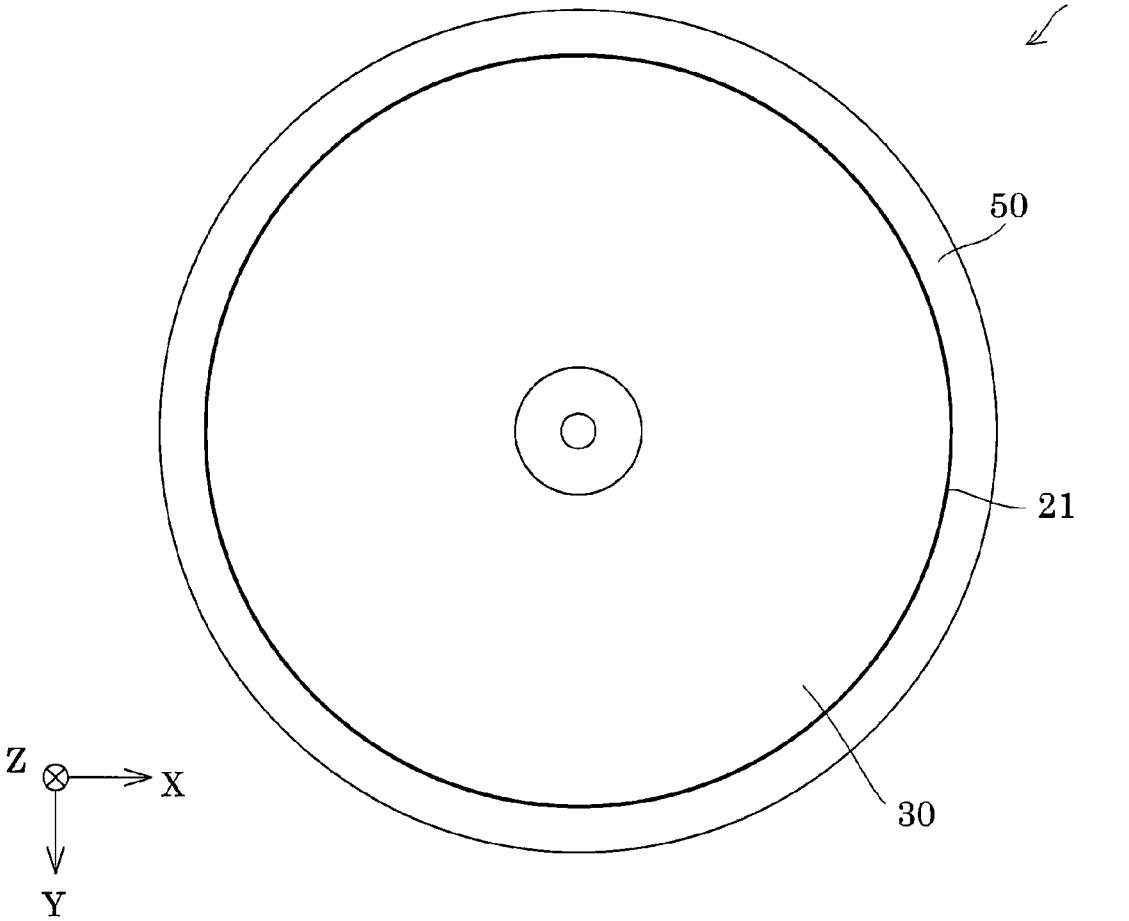
FIG. 19 is a plan view of the flow channel member according to the yet another embodiment.

As shown in FIGS. 18 and 19, the gap 105 between the first flow channel member 30 and the second flow channel member 40 is provided continuously in a direction along the Z-axis and in a direction along the XY plane. Then, the opening 105*a* of the gap 105 at the outer surface side is disposed at the outer circumferential surface extending in the +Z-direction which is the stacking direction of the first flow channel member 30 and the second flow channel member 40. Thus, the third flow channel member 50 is fixed to the side surfaces of the first flow channel member 30 and the second flow channel member 40, which are their outer circumferences extending in the +Z-direction. In other words, the third flow channel member 50 is disposed outside the first flow channel member 30 and the second flow channel member 40 when seen in the +Z-direction. The first flow channel member 30 and the second flow channel member 40 are circular when seen in the +Z-direction. The third flow channel member 50 has a shape conforming to the outer circumferences of the first flow channel member 30 and the second flow channel member 40, i.e., a circular, annular shape when seen in the +Z-direction. It goes without saying that the first flow channel member 30 and the second flow channel member 40 may be rectangular, polygonal, oval, or the like when seen in the +Z-direction. As long as the inner circumference of the third flow channel member 50 when seen in the +Z-direction is the same in shape as the first flow channel member 30 and the second flow channel member 40, the outer circumference of the third flow channel member 50 may be the same as or different from the shape of its inner circumference.

The third flow channel member 50 is fixed to the first flow channel member 30 and to the second flow channel member 40 via the melted first layer 21 and the melted second layer 22, respectively. The first layer 21 and the second layer 22 are provided adjacently in the +Z-direction with the opening 105*a* of the gap 105 interposed therebetween and are provided on substantially the same plane, i.e., provided at positions overlapping when seen in the +Z-direction, extending in the same plane direction.

The bump portion 45 is disposed inside the opening 105*a* of the gap 105, serving as a seal portion.

As shown in FIG. 19, the third flow channel member 50 is provided continuously throughout the entire circumference of the opening 105*a* of the gap 105, i.e., in such a manner as to cover the entire outer circumferences of the first flow channel member 30 and the second flow channel member 40. By thus covering the entire circumferences of the first flow channel member 30 and the second flow channel member 40, the third flow channel member 50 tightens and applies a load to the first flow channel member 30 and the second flow channel member 40 inward, so that the third flow channel member 50 can be brought into close contact with the first flow channel member 30 and the second flow channel member 40. Thus, in the flow channel member 20 shown in FIGS. 18 and 19, the laser bonding can be performed without using a glass jig, with the third flow channel member 50 tightening and applying a load to the first flow channel member 30 and the second flow channel member 40.

Figure 20:
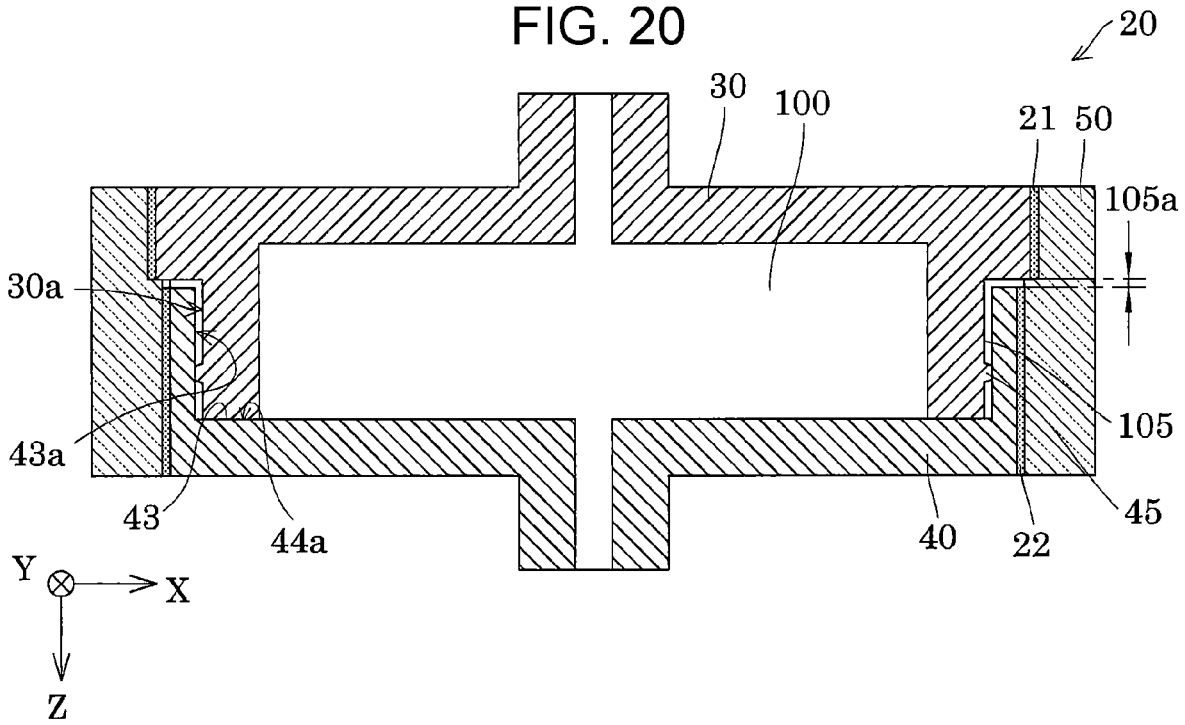
FIG. 20 is a sectional view of a flow channel member according to still another embodiment.

As shown in FIG. 20, the first layer 21 and the second layer 22 disposed adjacently in the +Z-direction with the opening 105*a* of the gap 105 interposed therebetween may be disposed at positions not overlapping when seen in the +Z-direction in such a manner that their principle surfaces extend in the same plane direction. In such a case, in order to have a small gap between the third flow channel member 50 and each of the first flow channel member 30 and the second flow channel member 40, the thickness of the third flow channel member 50 may be changed for each of its portion facing the first outer surface 34 (or in other words, the portion where the first layer 21 is to be formed) and its portion facing the second outer surface 46 (or in other words, the portion where the second layer 22 is to be formed).

Figure 21:
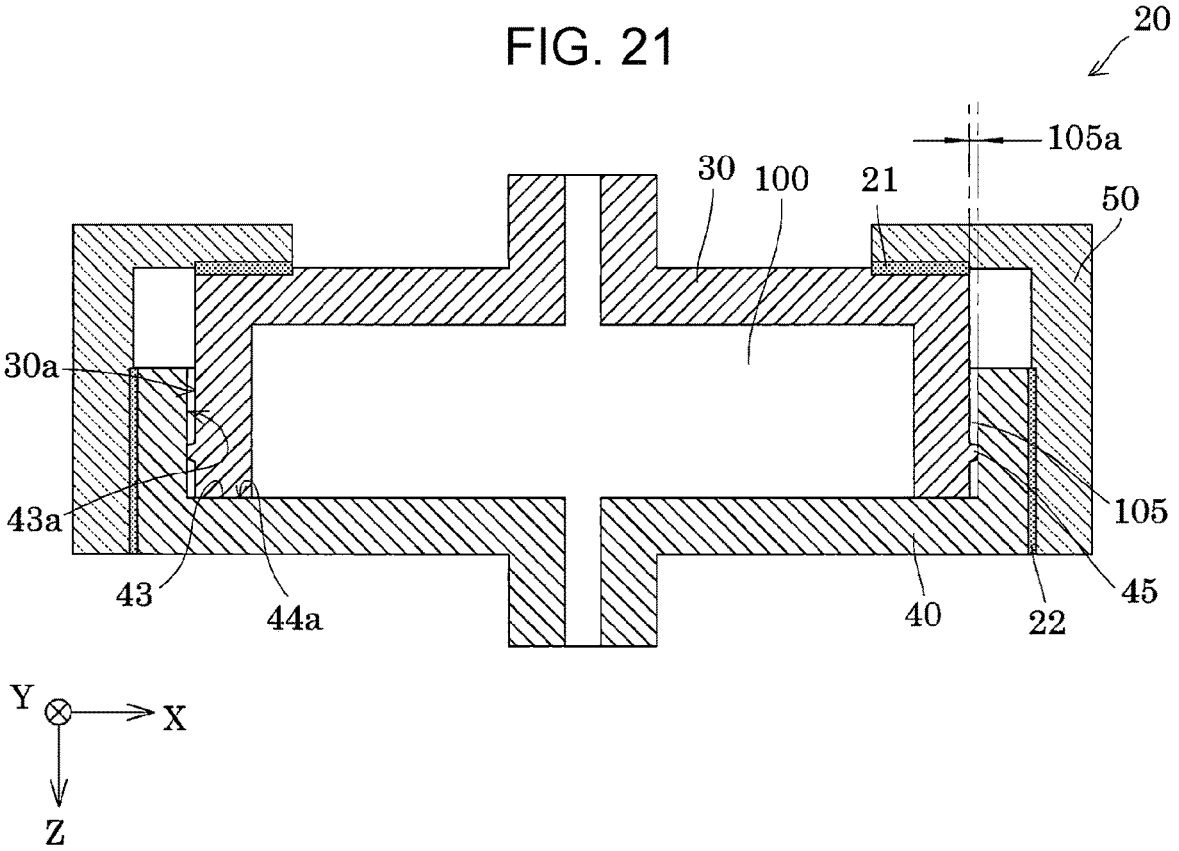
FIG. 21 is a sectional view of a flow channel member according to still another embodiment.

As shown in FIG. 21, the first layer 21 is disposed in contact with the opening 105*a* of the gap 105 when seen in the +Z-direction. The second layer 22 is disposed at a position slightly away from the opening 105*a* of the gap 105 outward when seen in the +Z-direction. Such a configuration also means that the first layer 21 and the second layer 22 are disposed adjacently on the XY plane with the opening 105*a* of the gap 105 interposed therebetween. In other words, what is meant by the first layer 21 and the second layer 22 being adjacently with the opening 105*a* of the gap 105 interposed therebetween includes the first layer 21 and the second layer 22 being disposed in such a manner as not to be in contact with the opening 105*a* when seen in one direction. Also, the first layer 21 is disposed along the XY plane, and the second layer 22 is disposed extending in the +Z-direction. Thus, what is meant by "the third flow channel member 50 closes the −Z-direction-side opening 105*a* of the gap 105 between the first flow channel member 30 and the second flow channel member 40" includes the third flow channel member 50 closing the opening 105*a* via a space which is defined by the first flow channel member 30, the second flow channel member 40, and the third flow channel member 50 and into which the opening 105*a* is open.

Even with the flow channel member 20 shown in FIGS. 20 and 21, the third flow channel member 50 is, like the configuration shown in FIG. 19, provided continuously in such a manner as to cover the entire outer circumferences of the first flow channel member 30 and the second flow channel member 40. Thus, also in the manufacturing of the flow channel member 20 in FIGS. 20 and 21, by tightening and applying a load to the first flow channel member 30 and the second flow channel member 40, the third flow channel member 50 can be brought into close contact with the first flow channel member 30 and the second flow channel member 40. Thus, the laser bonding can be performed without using a glass jig, with the third flow channel member 50 tightening and applying a load to the first flow channel member 30 and the second flow channel member 40.

Figure 22:
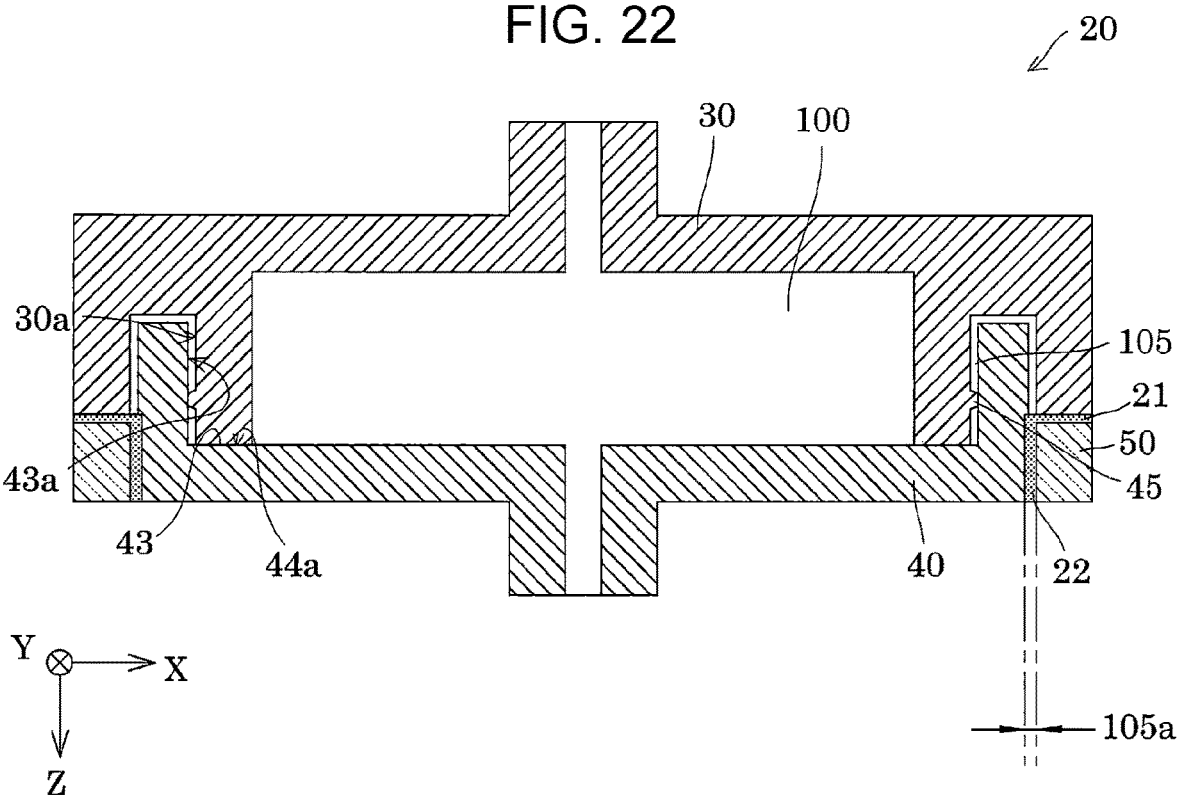
FIG. 22 is a sectional view of a flow channel member according to still another embodiment.

As shown in FIG. 22, the opening 105*a* of the gap 105 between the first flow channel member 30 and the second flow channel member 40 is provided in such a manner as to open in the +Z-direction. The first layer 21 and the second layer 22 are disposed adjacently with the opening 105*a* interposed therebetween. The first layer 21 is disposed along the XY plane, and the second layer 22 is disposed extending in the +Z-direction.

These configurations shown in FIGS. 17 to 22 also offer advantageous effects similar to those offered by the embodiments described above.

Also, although the head unit 2 exemplified in the above embodiments is formed by the recording head 10 and the flow channel members 20, the present disclosure is not limited to this. The recording head 10 may include the flow channel members 20. In other words, the head unit 2 in the above embodiments may correspond to the "liquid ejecting head."

Also, in the configuration of the flow channel member 20 exemplified in the above embodiments, the flow channel member 20 is provided with one inflow channel 103 and one outflow channel 104. However, the present disclosure is not limited to this. The flow channel member 20 may include two or more inflow channels 103 and two or more outflow channels 104, and the number of the inflow channels 103 and the number of the outflow channel 104 may be the same as or different from each other.

Also, although the inflow channel 103 and the outflow channel 104 are provided along the Z-axis in the examples shown in the above embodiments, the present disclosure is not limited to this. The inflow channel 103 and the outflow channel 104 may extend in a direction intersecting with the Z-axis.

Also, the bump portion 45 in Embodiment 1 and the flexible member 80 in Embodiment 2 may be used in combination. The bump portion 45 and the flexible member 80 may be provided at positions overlapping or not overlapping with each other when seen in the +Z-direction. When the bump portion 45 and the flexible member 80 are provided at positions not overlapping when seen in the +Z-direction, double sealing can be provided, which helps prevent ink leakage even more.

Also, although the filter F is provided inside the flow channel member 20 in the configuration exemplified in the above embodiments, the filter F does not have to be provided inside the flow channel.

Furthermore, the present disclosure targets at a broad range of liquid ejecting heads, and can be used for, for example, recording heads such as various types of ink jet recording heads used in image recording apparatuses such as printers. The present disclosure can also be applied to heads such as color material ejecting heads used in the manufacture of color filters such as liquid crystal displays, electrode material ejecting heads used in the electrode formation for organic EL displays, field-emission displays (FEDs), and the like, and bioorganic material ejecting heads used for the manufacture of biochips.

In addition, although the ink jet recording apparatus 1 is described as an example of a liquid ejecting apparatus, the present disclosure can also be applied to a liquid ejecting apparatus using any of the other liquid ejecting heads described above.

Also, the present disclosure targets at a broad range of flow channel members, and can also be used in devices other than liquid ejecting apparatuses and liquid ejecting heads.

What is claimed is:

1. A flow channel member comprising:

a first flow channel member non-transmissive of ultraviolet light and absorbent of laser light;

a second flow channel member non-transmissive of ultraviolet light and absorbent of laser light, the second flow channel member being stacked on the first flow channel member to define a flow channel for liquid to flow between the second flow channel member and the first flow channel member; and a third flow channel member transmissive of laser light, the third flow channel member being fixed to the first flow channel member and the second flow channel member in such a manner as to close a gap between the first flow channel member and the second flow channel member.

2. The flow channel member according to claim 1, comprising:

a first layer where the first flow channel member and the third flow channel member are melted with each other; and a second layer where the second flow channel member and the third flow channel member are melted with each other, wherein the first layer and the second layer are provided adjacently with an opening of the gap interposed therebetween, and extend in a same plane direction.

3. The flow channel member according to claim 2, wherein the first layer and the second layer are provided on substantially a same plane.

4. The flow channel member according to claim 3, wherein the first flow channel member has a first surface opposite from the first layer, the second flow channel member has a second surface facing the first surface, and at least one of the first surface and the second surface has a bump portion protruding toward the other one of the first surface and the second surface.

5. The flow channel member according to claim 4, wherein the bump portion is a seal portion provided in an annular form inside the opening of the gap when seen in a stacking direction of the first flow channel member and the second flow channel member, the seal portion liquid-tightly sealing between the first flow channel member and the second flow channel member.

6. The flow channel member according to claim 3, further comprising a flexible member, wherein the first flow channel member has a first surface opposite from the first layer, the second flow channel member has a second surface facing the first surface, and the flexible member disposed between the first surface and the second surface.

7. The flow channel member according to claim 6, wherein the flexible member is a seal portion provided in an annular form inside the opening of the gap when seen in a stacking direction of the first flow channel member and the second flow channel member, the seal portion liquid-tightly sealing between the first flow channel member and the second flow channel member.

8. The flow channel member according to claim 1, comprising a seal portion provided inside the opening of the gap when seen in a stacking direction of the first flow channel member and the second flow channel member, the seal portion liquid-tightly sealing between the first flow channel member and the second flow channel member.

9. The flow channel member according to claim 1, wherein the first flow channel member and the second flow channel member are non-transmissive of visible light.

10. The flow channel member according to claim 1, wherein when seen in a stacking direction of the first flow channel member and the second flow channel member, the third flow channel member has a smaller area than the first flow channel member and the second flow channel member.

11. A liquid ejecting head comprising:

the flow channel member according to claim 1; and a nozzle configured to eject liquid supplied from the flow channel member.

12. A liquid ejecting apparatus comprising:

the liquid ejecting head according to claim 11; and a liquid retainer that retains liquid to be supplied to the flow channel member.

13. The liquid ejecting apparatus according to claim 12, wherein the nozzle configures to eject an ultraviolet light curable ink to a target.

14. The liquid ejecting apparatus according to claim 13, comprising an irradiator that irradiates the target with ultraviolet light to cure the ultraviolet light curable ink attached to the target.

15. A liquid ejecting apparatus comprising:

the flow channel member according to claim 1;

a nozzle configured to eject liquid supplied from the flow channel member; and a liquid retainer that retains liquid to be supplied to the flow channel member.

16. A method for manufacturing a liquid ejecting apparatus including a nozzle that ejects liquid and a flow channel member having a first flow channel member non-transmissive of ultraviolet light and absorbent of laser light, a second flow channel member non-transmissive of ultraviolet light and absorbent of laser light, the second flow channel member being stacked on the first flow channel member to define a flow channel for liquid to flow between the second flow channel member and the first flow channel member, and a third flow channel member transmissive of laser light, the method comprising fixing the third flow channel member to the first flow channel member and the second flow channel member by laser bonding in such a manner that the third flow channel member closes a gap between the first flow channel member and the second flow channel member.

17. The method for manufacturing a liquid ejecting apparatus according to claim 16, wherein the first flow channel member has a first outer surface which is a portion of an outer surface of the first flow channel member and a first surface opposite from the first outer surface, the second flow channel member has a second surface facing the first surface, the flow channel member includes a bump portion provided at least one of the first surface and the second surface and protruding toward the other one of the first surface and the second surface or a flexible member disposed between the first surface and the second surface, and with the bump portion being crushed or the flexible member being flexed by a transmissive jig applying a load to the third flow channel member, the laser light is applied to the first flow channel member and the second flow channel member via the jig and the third flow channel member to perform laser-bonding.

* * * * *